US010617244B1

(12) United States Patent
Lantz

(10) Patent No.: US 10,617,244 B1
(45) Date of Patent: Apr. 14, 2020

(54) EASYMEAL FOOD AND DRINK DISPENSING DEVICE

(71) Applicant: Aron J. Lantz, Williamsport, PA (US)

(72) Inventor: Aron J. Lantz, Williamsport, PA (US)

( * ) Notice: Subject to any disclaimer, the term of this patent is extended or adjusted under 35 U.S.C. 154(b) by 183 days.

(21) Appl. No.: 15/098,749

(22) Filed: Apr. 14, 2016

Related U.S. Application Data

(60) Provisional application No. 62/148,733, filed on Apr. 16, 2015, provisional application No. 62/184,246, filed on Jun. 24, 2015, provisional application No. 62/310,801, filed on Mar. 20, 2016.

(51) Int. Cl.

| | |
|---|---|
| ***A47G 21/00*** | (2006.01) |
| ***A47G 21/18*** | (2006.01) |
| ***A47G 19/22*** | (2006.01) |
| ***A47G 23/02*** | (2006.01) |
| ***B65D 25/04*** | (2006.01) |
| ***B65D 25/30*** | (2006.01) |
| ***B65D 83/00*** | (2006.01) |

(52) U.S. Cl.
CPC ..... *A47G 21/001* (2013.01); *A47G 19/2266* (2013.01); *A47G 21/18* (2013.01); *A47G 23/0216* (2013.01); *B65D 25/04* (2013.01); *B65D 25/30* (2013.01); *B65D 83/0011* (2013.01)

(58) Field of Classification Search
CPC .. A47K 5/1217; B65D 81/32; B65D 81/3205; B65D 81/3211; B65D 81/3255; B65D 25/04; B65D 43/02; B65D 85/80; B65D 83/0005; B65D 85/8043; B65D 81/3216; B65D 81/3222; B65D 83/0038; B65D 865/085; B65D 85/8046; B65D 65/466; B65D 25/02; B65D 8/3211; B65D 25/03; B65D 83/0011; B65C 81/3216; B65C 81/3222; B65C 83/0038; A47G 19/32; A47G 19/34; A47G 21/18; A47G 21/184; A47G 19/02; A47G 21/001; A47G 19/2266; A47G 23/0216
See application file for complete search history.

(56) References Cited

U.S. PATENT DOCUMENTS 2,321,519 A * 6/1943 Rubinoff ..... A23G 9/503 215/392
3,283,889 A 11/1966 Hetrick et al.
3,702,203 A * 11/1972 Oltmanns ..... B65D 71/50 206/150

(Continued)

FOREIGN PATENT DOCUMENTS

WO WO-2013173762 A1 * 11/2013 ..... B65D 81/3211

*Primary Examiner* — Ericson M Lachica

(57) ABSTRACT

A novel food dispensing device is described which includes a tubular container for holding the food to be consumed, a pushing apparatus which fits inside of the container like a piston in a cylinder and is moved upward to push the food out of an opening in the container. This will allow handicapped persons, or other users that only have one free hand to feed themselves, since it only requires a single hand to operate. In alternate embodiments, there is also a beverage container and a tube ending near the container opening, allowing one to drink the beverage from the tube by only having to move his/her head and without the user to physically change positions. Another embodiment, employs multiple dispensers for feeing several people simultaneously.

15 Claims, 19 Drawing Sheets

(56) References Cited

U.S. PATENT DOCUMENTS 5,490,653 A * 2/1996 Ingwersen ..... B60N 3/102 248/311.2
5,860,557 A * 1/1999 Willbrandt ..... B65D 1/265 220/669
5,893,461 A * 4/1999 Walters ..... B65D 77/225 137/493
6,261,611 B1 * 7/2001 Berman ..... B65D 81/343 426/107
8,192,084 B2 6/2012 Dolenc
2001/0000480 A1 * 4/2001 Stagg ..... B65D 33/16 428/43
2001/0032791 A1 * 10/2001 Hudson ..... A47G 23/02 206/217
2005/0011778 A1 * 1/2005 Thomas ..... B65D 85/78 206/204
2006/0016719 A1 * 1/2006 Cassese ..... A47G 19/06 206/564
2011/0177205 A1 * 7/2011 Bardazzi ..... A47J 31/0668 426/77
2012/0048896 A1 * 3/2012 Mainville ..... B65D 47/06 222/481.5
2012/0141641 A1 * 6/2012 Wells ..... B65D 83/0044 426/115
2012/0234843 A1 * 9/2012 Zaporski ..... B65B 61/202 220/694
2012/0277700 A1 * 11/2012 Amer, Jr. ..... A61F 5/445 604/332
2014/0037807 A1 * 2/2014 Delane ..... B65D 75/008 426/383
2014/0263365 A1 * 9/2014 Tollen ..... A47G 19/065 220/575
2015/0108123 A1 * 4/2015 Linehan ..... A47D 3/00 220/17.1
2015/0182054 A1 * 7/2015 Shames ..... A47G 23/0641 206/217

* cited by examiner

SIDE VIEW

PERSPECTIVE VIEW

EASYMEAL FOOD AND DRINK DISPENSING DEVICE

CROSS-REFERENCE TO RELATED APPLICATIONS

The present application is a non-provisional application which claims benefit to Provisional Application No. 62/148,733, entitled "Drive-Up-Cup Food Dispenser", filed Apr. 16, 2015. The present application also claims benefit to Provisional Application No. 62/184,246, entitled "Easy Meal Food and Drink Dispenser", filed on Jun. 24, 2015. The present application also claims benefit to Provisional Application No. 62/310,801 entitled "Easy Meal Food and Drink Dispensing Point Receptacle", filed on Mar. 20, 2016. All three of the applications stated above are hereby incorporated by reference as if set forth in their entirety herein.

BACKGROUND OF THE INVENTION

People typically eat food in a variety of different ways. Spoons, forks, and dinner plates are traditional tools used for eating food. Feeding oneself with hand to mouth is another method that was once the original way before eating utensils were developed. This method became popular again as "fast food" concepts grew. People would use their hands to pick up sandwiches such as hamburgers in a bun, hotdogs in a bun, and longer sandwiches called hoagies which are on a bun, also sandwiches called a "wrap" where a food filling rolled up in a soft tortilla shell became popular. The food of the sandwich style variety is often packaged for carry out of the restaurant. The current packaging seems to work fairly well to take the food out of the restaurant without spilling it. Many types of packaging for sandwich type products do not transition well to actually holding the food while being able to eat it without spilling it, or preventing it from having juices dripping out, or preventing particles from falling out and onto one's clothing.

Often sandwiches are packaged in a folded paper wrapper. Drinks provided in restaurants range from waxed cardboard cups with lids to cans and bottles. Current packaging does not make it possible to eat one-handed very well without spilling, let alone holding a drink nearby enough to take a sip of drink right after taking a bite of the sandwich without setting one thing down to pick another one up. Currently, there is no packaging that allows eating of a restaurant packaged sandwich with a single hand.

Another goal not well served with the current art of food/drink utensils and packaging is also drinking while holding the food with one hand. Often eating one handed with current art in food packaging results in spilled food, and soiled clothing from food juices.

Soups, chili, spaghetti, casseroles, vegetables, and fruits do not package well for eating in a fast-food fashion. To eat these types of food usually requires a sit-down meal with eating tools in the form of plates, forks, spoons, and knives.

Utensils, such as forks, spoons and knives typically require a firm surface like a table and one hand at least to eat. If one does not have a table then they must hold the plate and use the fork or spoon to raise the food from the plate to the mouth. In some countries, chopsticks have been used to bring the food from the bowl into the mouth, and that takes two hands, one to hold the bowl and the other to push the food into the mouth with the chopstick or other implement like a spoon.

With the advent of fast food, emphasis has been on making and selling easily packaged food that is not messy, and that has been the objective held higher than food quality, nutrition and ways of serving healthier food.

Eating quality healthy food as fast food has not been very easy to obtain because it does not fit the mold of fast food. The food is often served as fast food with bread, buns, or tortilla wraps to give a person the ability to hold onto the food without having messy insides come out all over the place. Nuggets of deep fried food are now popular in the fast food industry, not because they are good for your health, but because they are easy to eat and package easily. Food is not as healthy as it could be at fast food establishments because it is not convenient to eat healthy foods like a home-cooked meal without the standard tools, forks, spoons, plates, table, etc.

There is currently no acceptable way of packaging and serving juicy, or liquid foods like soups, casseroles, lasagna, so that that they can be eaten while driving. Also if one has a disability such as inoperable hands (paralysis, severe arthritis) it may not be possible to eat with conventional utensils. Kids are more regularly eating in cars, which typically causes a large mess.

Today's society has become a busy on the move type of society that has taken up the concept of multi-tasking and integrated it into our lives as a regular occurrence of everyday activities. For example, whether it is talking and typing or working and walking on a desk treadmill, people are capable and often perform two physical functions at once.

One area that people regularly multi-task is during the consumption of food items. Some examples of where people often try to multitask while consuming food or drink are while they perform work functions and eat simultaneously due to time constraints or teenagers that are overly involved in their video game system and want a snack while they conquer the galaxy or a person that is on a road trip and needs to consume their food as safely as possible while getting to their destination. A majority of the functions people dually attempt while consuming food require a significant share of the person's attention compared to eating or drinking. Accordingly, there is a need for an efficient manner to consume food while being able to concentrate and perform another physical function.

One way people have attempted to solve the problem of having meals on the go has been the development of fast food. Fast food restaurants provide people with food items such as hamburgers and French fries, sodas in various sizes, tacos, burritos and a variety of other items that are quick to make, but not healthy to consume on a regular basis. Restaurants and shops that offer freshly made submarine sandwiches have attempted to address the health aspect of the fast food issue but items like the submarine sandwich or wraps are difficult to consume using only one hand. Further, they are generally messy even if two hands are used to hold the sandwich together due to components of the sandwich falling out (e.g. dropped pickles, lettuce, onions, etc.), crumbs from the bread falling, or dressing or sauce dripping from the sandwich. It is difficult to eat healthy and be able to multitask due to the physical necessity to use two hands to adequately maneuver the sandwich for consumption or not to have a mess from food items falling or dripping out all over. Accordingly, there is a need for an efficient manner to consume food while being able to concentrate and perform another physical function and to prevent a mess during the consumption of food and another function.

The fast food industry creates a lot of packaging waste related to food consumed in-store and take-out. There is a current need to reduce the amount of waste in this industry, while still having adequate packaging for various foods. Though it varies, the average four-person meal from a fast food restaurant generates approximately 1.5 cubic feet of un-compacted waste. Even the healthier types of food are typically served to customers and consumers in paper or plastic containers and/or wrappers that create a significant amount of refuse. Even if the person makes their meal at home and wants to eat it on the go, the food item still requires some sort of transport container or covering and the generally available and affordable materials are plastic sandwich bags or plastic wrap. The alternative is to use a reusable plastic container but these types of containers are not made to be held or practical to hold while consuming the food item while trying to simultaneously perform another task.

Currently, there is a need for an efficient manner to consume food and drinks while being able to concentrate and perform another physical function and to prevent a mess during the consumption of food while not creating a significant amount of waste or refuse.

FIELD OF THE INVENTION

The invention is directed toward the short term storage, holding, containing, transporting, and dispensing of food and/or beverages in an efficient manner generally allowing a person to consume food or beverage while simultaneously performing another physical activity.

BRIEF SUMMARY OF THE INVENTION

The invention herein solves the problems of having a device that can efficiently contain and allow the consumption of food items in a manner that will permit a person to simultaneously perform another physical activity while the device prevents spillage of the food item from creating a mess. The present invention can also decrease the amount of (fast) food item related refuse by being manufactured from reusable or recyclable materials.

The current invention holds and dispenses various forms of foods ranging from sandwiches to thick soups such as chili, or other thicker things and non-homogenous food items such as spaghetti with meatballs.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention it is shown in the drawings embodiments which are presently preferred. It should be understood, however, that the invention is not limited to the precise arrangements and instrumentalities shown in the drawings.

DETAILED DESCRIPTION OF THE INVENTION

Figure 1:
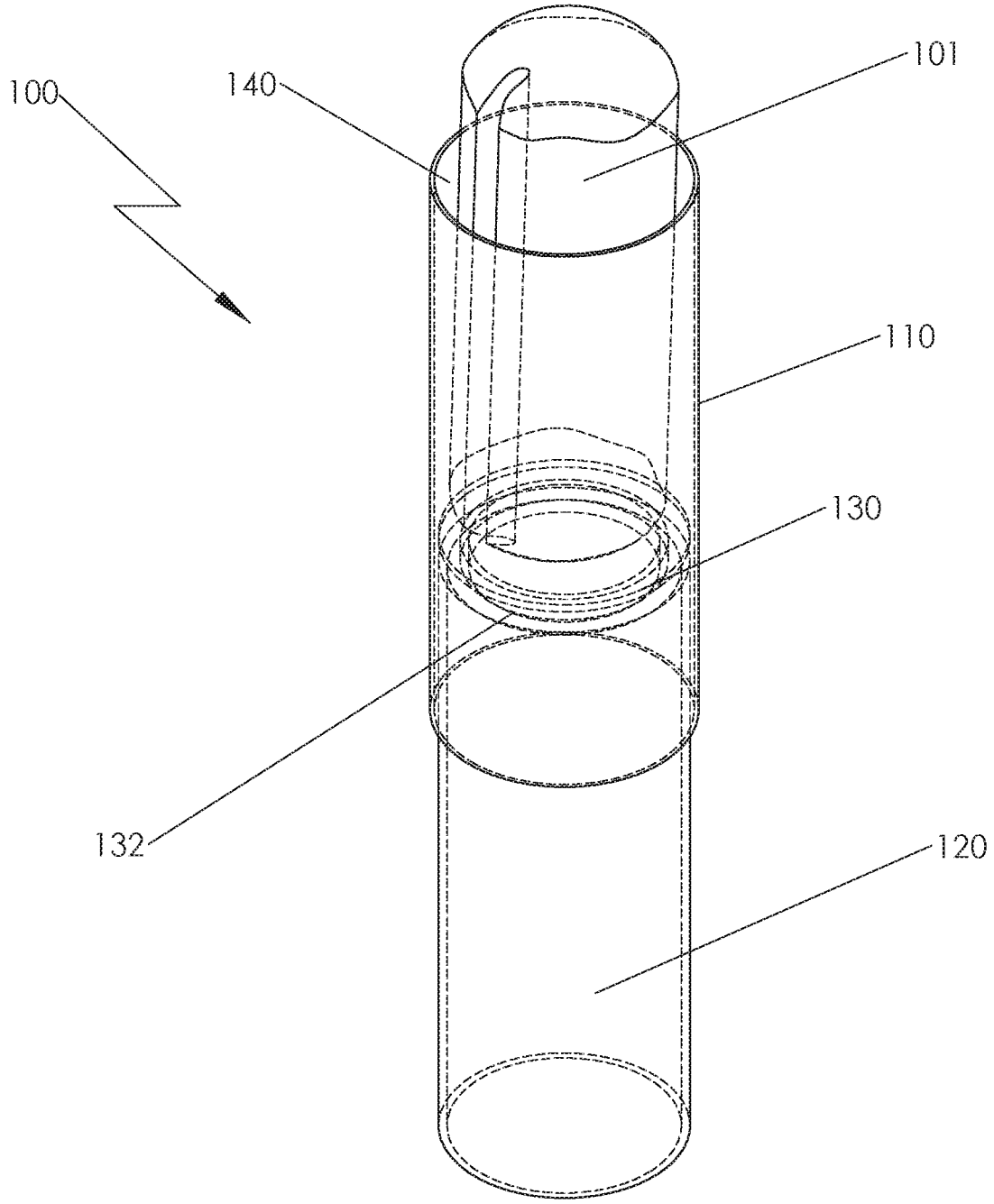
FIG. 1 is a perspective side view representation of an embodiment of the food dispensing device.

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It should be understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

The embodiments of the current invention are designed to act as tools in assisting those eating food without the ability to use both hands. This may include young children, disabled people. It may also assist those who are busy using their other hand for other things, such as driving, operating a computer mouse, etc. The current invention provides food and drink from a common receptacle with a means of advancing the food. Both the food and drinks are provided near each other in close proximity to enable nearly simultaneous eating and drinking. Eating and drinking is assisted by the invention for when using one or no hands.

Elements having the same reference numbers refer to the same element throughout the specification and figures, even if they are provided in different figures, or different parts of the specification.

Referring now to the figures, FIG. 1 shows an exemplary embodiment of a food dispensing device 100 comprised of but not limited to a cylindrical container 110 made from a material that will resist leaking and crushing, for the purpose of containing the food item(s) 101 or similar item(s) and having an opening 140 at the top end and an enclosure seal apparatus 130 at the bottom end. The seal apparatus 130 is generally disc shaped to coincide with the inner circumference of the container 110 and also made from a plastic polymer or other suitable material. The seal apparatus 130, which may include an O-ring seal 132, is capable of sliding within the container 110, generally upwards toward the opening 140 of the container 110. The embodiment 100 of the invention in FIG. 1 is further comprised of a pushing apparatus 120 which is also made from a material which will resist leaking and crushing. It is cylindrical in shape and is proportionate in size so that the circumference of the pushing apparatus 120 is slightly smaller than the container 110 but yet fits snuggly against the inner perimeter of the lower end of the container 110 and is held in place by friction when the inner surface of the bottom end of the container 110 comes into contact with the outer surface perimeter of the top end of the pushing apparatus 120. In an embodiment, it resembles the top of a piston.

The pushing apparatus 120 of the inventive embodiment 100 is further comprised of a top end and a bottom end. The top end of the pushing apparatus 120 is comprised of a recess around the top perimeter which receives an O-ring seal 132 creating a seal against the inside surface of the container 110. The seal incorporated into the top end may be separate or integral.

The embodiment 100 of the present invention is further comprised of assembling the pushing apparatus 120 and the container 110 by placing the top end of pushing apparatus 120 into the bottom end of the container 110 until the contact surface of the pushing apparatus 120 touches and makes contact with the seal apparatus 130 in the container 110.

The present invention is operated by using a proportionate amount of force on the pushing apparatus 120 wherein the contact surface of the pushing apparatus 120 drives the seal apparatus 130 within the container 110 toward the top of the container 110 which in turn lifts the food item 101 held in the container 110 out the opening 140 of the container 110 enabling consumption of the food item 101. The top of the pushing apparatus 120 may contain a recess for the O-ring seal.

A pre-packaged food cartridge may be used in some cases for convenience. This allows for quick, clean and easy loading.

Figure 2A:
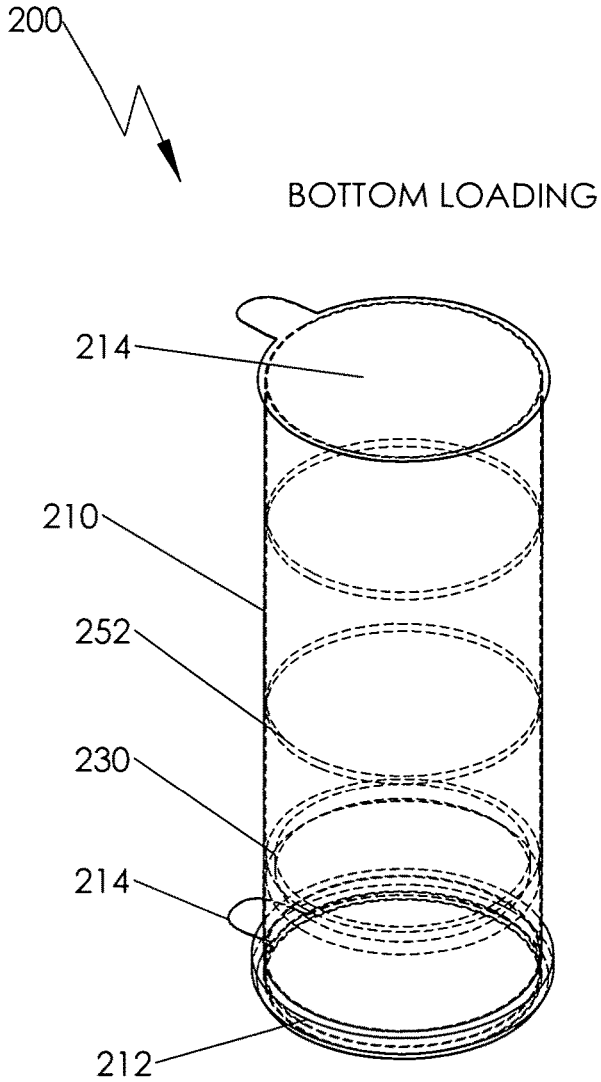
FIG. 2A is a perspective side view representation of bottom loading embodiment of the food cartridge for loading into the container.

Referring now to FIG. 2A, FIG. 2A shows an embodiment 200 of the present invention which shows a food cartridges 210 which are pre-filled with a food and sealed. Once the food cartridge is purchased from a store, the protective seals 214 over the opening at the top, and the bottom are removed. The food cartridge 210 is then inserted into the container 110 of FIG. 1 for use.

In FIG. 2A, food cartridge 210 includes seal apparatus 230 but may further include separators 252 within the container for the purpose of compartmentalizing different types of food items within the container 210. The top and/or bottom seals 214 enclose the container 210. These seals 214 may be made replaceable, such that they may be removed and replaced back on for repeated use of the container 210.

The cartridge 210 is placed in the container 110, or is used in place of container 110. The pushing apparatus is sized to fit inside of cartridge 210. As pushing apparatus moves upward, it pushes out the foods in the cartridge out of the top opening 140 of FIG. 1. The separators 252 are designed to either move with the foods out of the top opening 140, or rupture causing the foods in different compartments to mix during consumption.

FIG. 2A also shows a lip 212 on the outer circumference of the bottom of the cartridge 210 used to assist in securing the cartridge 210 in place when the cartridge 210 is used in conjunction with the container 110 shown in FIG. 1.

Figure 2B:
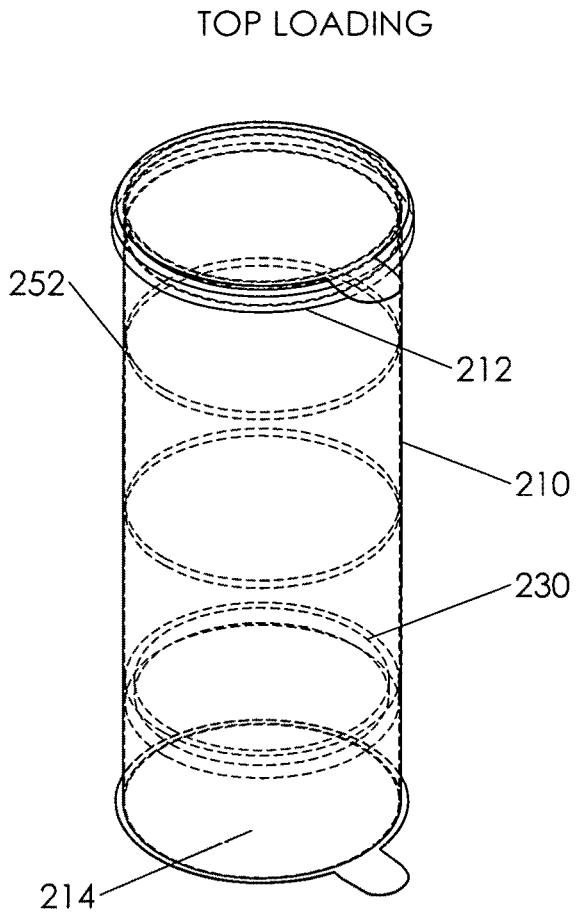
FIG. 2B is a perspective side view representation of a top loading embodiment of the food of the food cartridge for loading into the container.

FIG. 2B also shows another embodiment 200 of the food cartridge 210 and the seal apparatus 230 but also may further include separators 252 within the container for compartmentalizing different types of food items within the container 210. The inventive embodiment 200 is further comprised of top and/or bottom seal 214 to enclose the container 210.

FIG. 2B also shows a cartridge 210 that is further comprised of a lip 212 on the outer circumference of the top of the cartridge 210 that assists securing the cartridge 210 in place when the cartridge 210 is used in conjunction with container 110, as shown in FIG. 1.

The cartridges 210 of FIGS. 2A and 2B are intended to be prepackages and sold filled and sealed. The food cartridge expands the usability of the current invention to pre-packaged food. Actually the food cartridge outer wall forms the inner sleeve of the food dispenser unit, almost like a skin, and inside has a short internal plunger disk that is actuated by the pushing apparatus 120 of FIG. 1.

Alternatively, the cartridge may be made of reusable material. It may have replaceable seals 214 which can be removed and replaced back on for repeated sealing of the cartridge 210. It can then be filled from the top or bottom, sealed and pre-stored.

Figure 3:
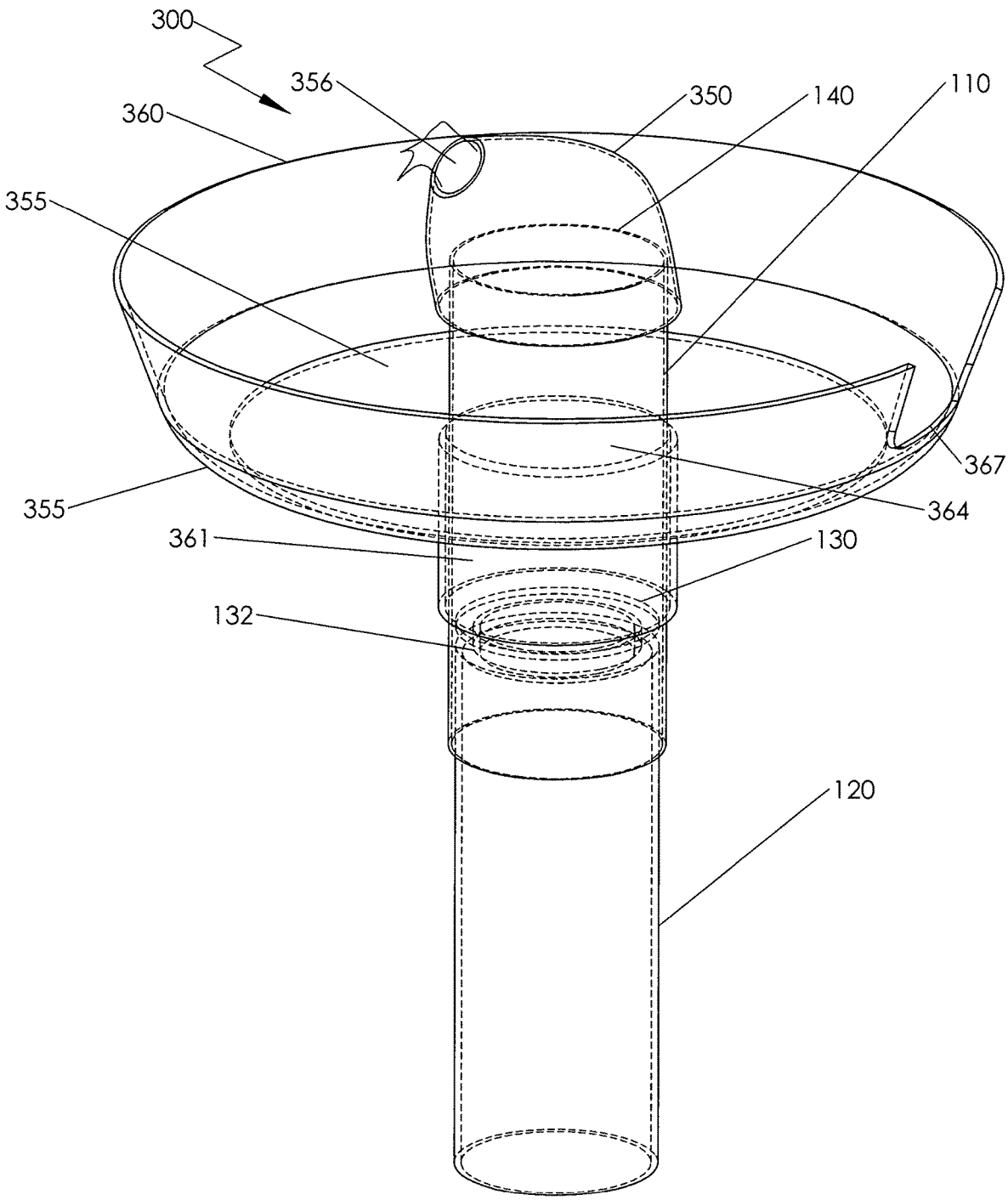
FIG. 3 is a perspective side view representation of another embodiment of the food dispensing device.

Now referring to FIG. 3, it shows another embodiment 300 which further includes of a 'drip tray' or simply a 'tray' 360, which fits into and is held by a suitably sized opening 364 in the center to hold the container 110. The tray 360 is designed to have the purpose of catching food items or dripped sauces or other substances that fall or are otherwise propelled from opening 140 of the container 110 and thus preventing the food item from creating a mess while it is being consumed. The tray 360 adds to the usability of the device in that it holds the beverage/drinking straw and the container 110 as well in close proximity to each other, and it provides the added benefit of catching spillage.

Embodiment 300 of the present invention employs a tray 360 having a wrist notch 367 on one side for the purpose of allowing the user's hand to access and grip the upper end of the container 110.

The tray 360 further includes a container guide 361 that extends downward from around the circumference of the tray opening 364 forming a central support structure for the container 110.

Additionally, the inventive embodiment 300 shows the invention comprises a nozzle attachment 350 having a food outlet 356 designated for use with food items that are generally liquid in nature such as chili to assist in preventing spills or otherwise controlling the dispensing flow of the food item. A person can position their mouth near the nozzle 350 to eat food from the opening 356 in the nozzle 350.

FIG. 3 includes the elements denoted by the same reference numbers in previous figures.

Figure 4:
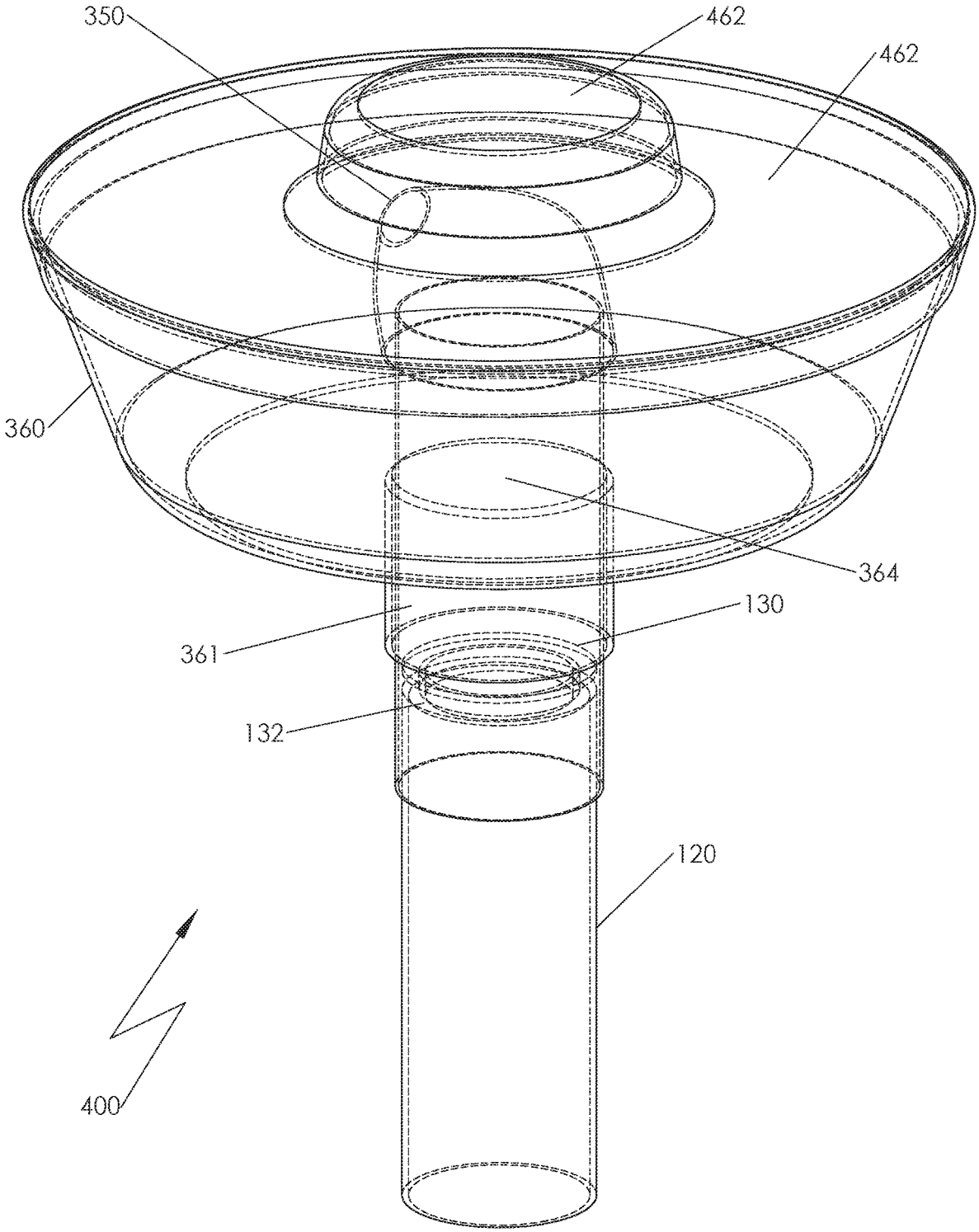
FIG. 4 is a perspective side view representation of another embodiment of the food dispensing device.

FIG. 4 shows another embodiment 400 which further comprises a cover 462 that covers the tray 360. The cover 4624 has a size and shape to mate with the upper perimeter of the tray 360. The cover 462 is designed and adapted to secure to the upper perimeter edge of the tray 360 by having a lip that extends downward and slightly in toward the center axis of the cover 462 creating a flexible, yet sturdy attachment point to secure the cover 462 to the tray 360 thereby preventing spills or food items from escaping the tray 360 during transport of the invention.

Figure 5:
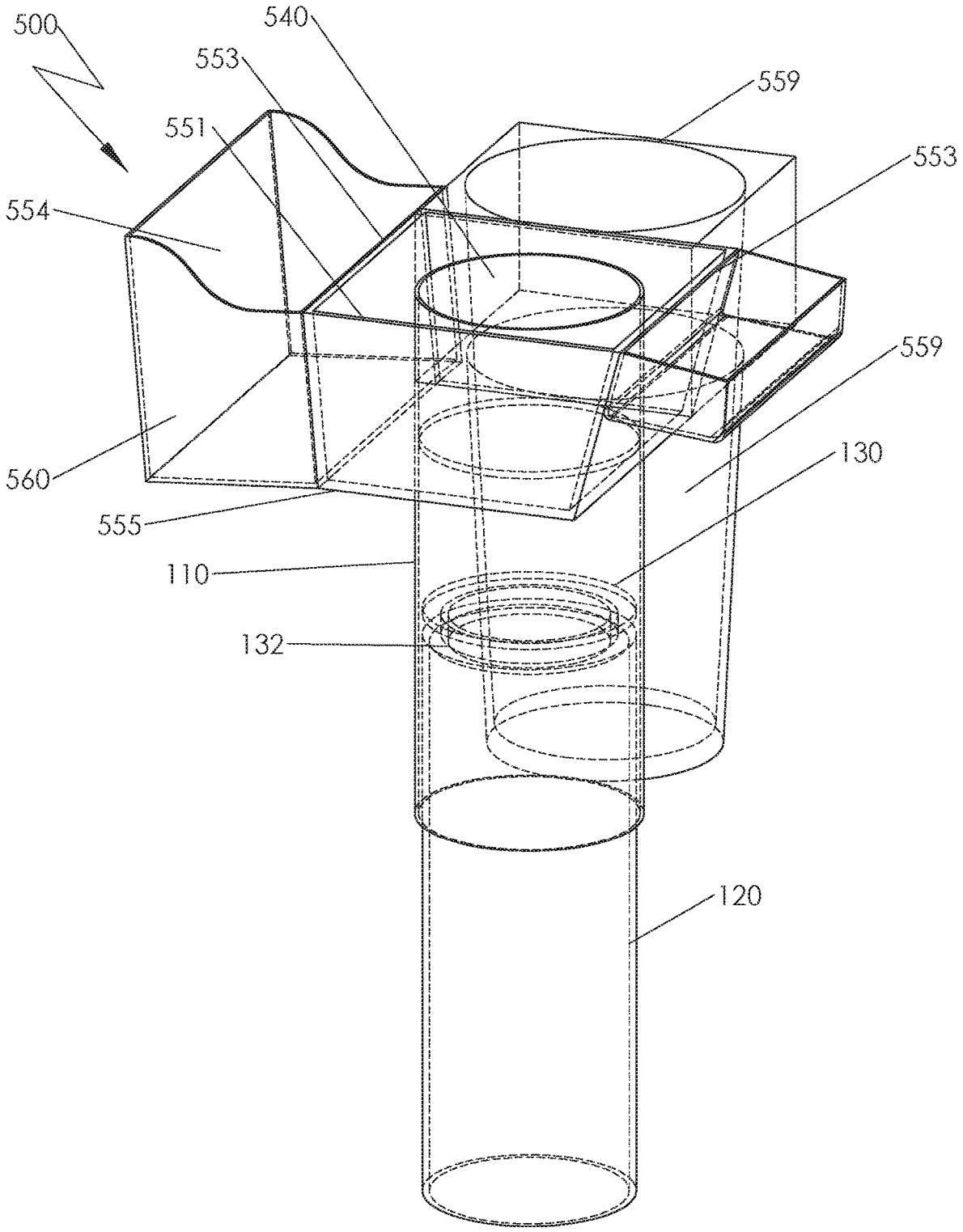
FIG. 5 is a perspective side view representation of another embodiment of the food dispensing device.

The tray may also function as a food tray, as shown in embodiment 500 of FIG. 5. The tray 560 may have dividers 553 that extend upward from the bottom surface 555 of the tray 560 to the top edge of the outer wall 551 of the tray 560 in turn creating compartments 554 within the inner dimensions of the tray 560. Not all dividers 553 have to start at the bottom surface. The embodiment 500 is only one variation of configuration of a compartmentalized tray 560 wherein the exemplary compartments 554 shown would likely be suited for placing a "side order" such as French fries, onion rings, or similar food item. Another of the other compartments 554 would be useful as a place for condiments for dipping the food items, and yet another of the compartments 559 for holding a beverage container. The compartmentalization of the tray 560 can be molded and made to suit particular uses or food items and is not limited only to the design or uses stated above.

FIG. 5 also includes the container 110, O-ring seal 132, seal apparatus 130, pusher apparatus 120 and the other elements having the same reference numbers which have been described in connection with the previous figures.

Figure 6:
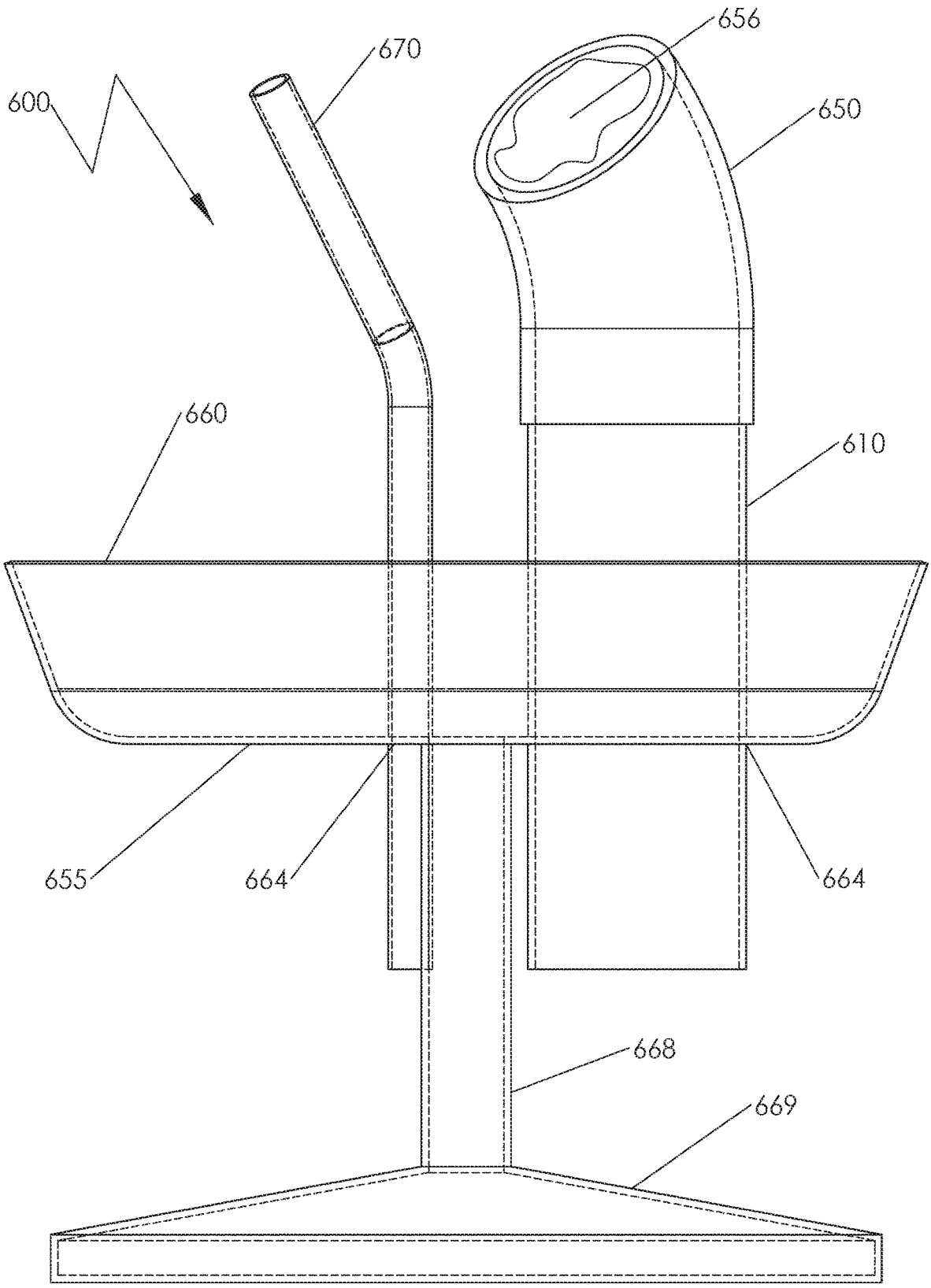
FIG. 6 is a side view representation of another embodiment of the food dispensing device.

FIG. 6 shows an embodiment 600 of the present invention wherein the invention comprises a tray 660 with two openings 664 in the bottom surface 655. The openings 664 are offset from the central axis of the tray 660 and are proportionate in size and circumference for one of the openings 664 to accommodate the container 610 and the other opening 664 is proportionate in size and circumference to accommodate a fluid conveyance device 670 hereafter to be referred to as a "straw" of which the primary function of the straw 670 is to allow the user of the invention to drink a beverage. The embodiment of the invention shown in FIG. 6 further comprises a support 668 which may be made out of a disposable paper material or a rigid plastic polymer or other suitable material. The support 668 extends downward from the center of the tray 660 and intersects and inserts into a base 669. The base 669 is also made from a rigid plastic polymer or other suitable material and provides a suitable foundation to allow the device to be self-supportive without the necessity of being held by a person. The base 669 may further comprise a circular indentation on the top surface that is aligned under the location of the straw 670 for the purpose to accommodate and assist in keeping a beverage container (not shown in this figure) in place. The beverage container is intended to be placed at the bottom of the straw 670. The container 610 is intended to use a pusher apparatus (not shown in this figure) but similar to any of those described herein.

A variation of the nozzle attachment described earlier is shown here as element 650 having a food outlet 656.

This embodiment provides food and drink out of the same vessel such that the food is pushed up to the food outlet 656 at about the same location as where the beverage is being provided (the end of straw 670). The drinking and eating locations are immediately adjacent so that a person merely has to turn their head slightly or move it front to back to access both the drink and the food. The food and drink are provided to a common location that is convenient for the user's mouth to reach. This provides a novel way of delivering both food and beverage in close proximity from each other at a "Dispensing Point" and this allows eating and drinking with no hands, or one handed operation depending on the embodiment shown.

The addition of the support 668 and base 669 permits the present invention to be placed on a flat or table-like surface and allows the completely hands-free operation of the invention.

The base 669 may also be securely mounted on vehicles, such as a car or on a motorcycle gas tank. This may assist a motorcycle rider in having a quick snack.

Figure 7:
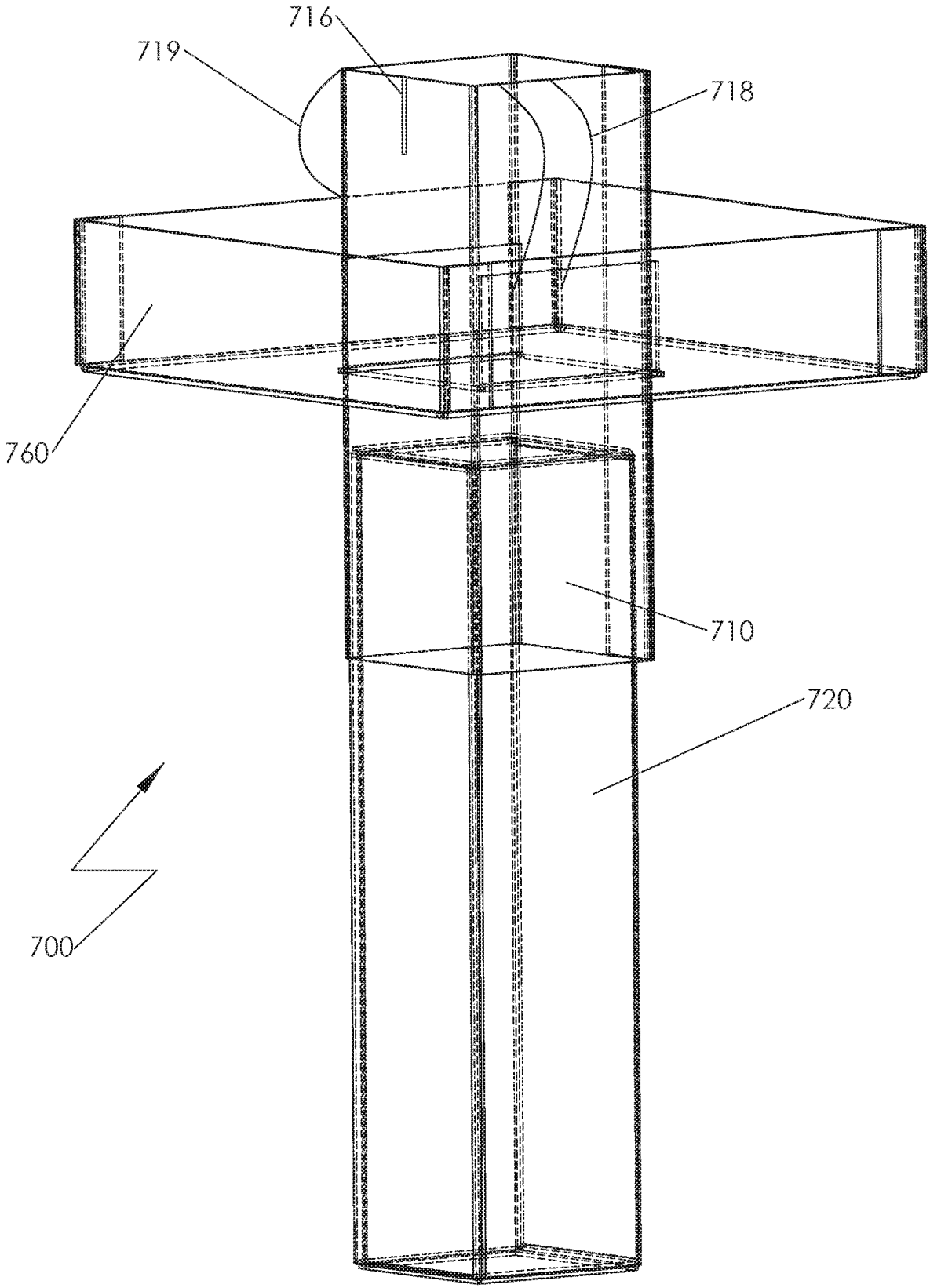
FIG. 7 is a perspective side view representation of another embodiment of the food dispensing device.

FIG. 7 shows an embodiment 700 of the present invention wherein the container 710, pushing apparatus 720, and tray 760, are comprised of a square or rectangular cross-section as opposed to the previously described cylindrical or circular forms. The embodiment 700 is in a form that could be readily utilized in the fast food industry as it would allow for the protective container 710, pushing apparatus 720, and tray 760 to be made inexpensively and in a material that could be disposed of after use. The upper portion of the protective container 710 forms a flexible food grip cuff with four finger loop 718 and thumb loop 719 to allow the hand to grip and control the food.

The portion of container 710 is flexible with either slits 716 or accordion folds to allow it to bend and hold food as a flexible food grip cuff.

Alternatively, this embodiment may be manufactured of a durable material suitable for repeated use in order to meet the issue of decreasing the amount of waste created by the fast food industry.

Alternatively, a geometrical or other cross sectional shape may be used.

Figure 8:
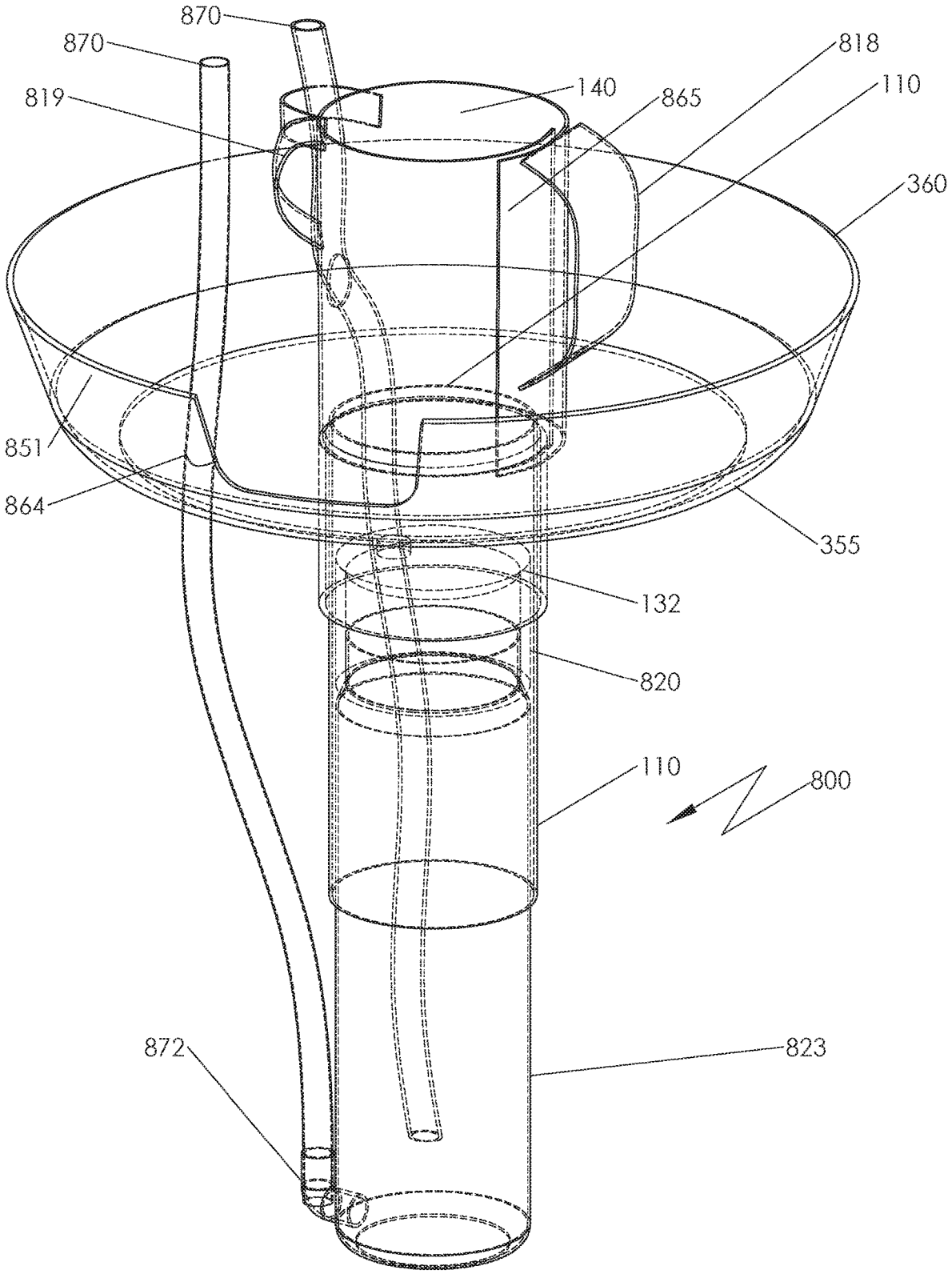
FIG. 8 is a perspective side view representation of another embodiment of the food dispensing device.

FIG. 8 shows an embodiment 800 of the present invention wherein the invention is comprised of a container 110 in a centrically located position relative to the tray 360, similar to that of FIG. 3. The embodiment in FIG. 8 further comprises of a pushing device 820 that has been adapted to accommodate a beverage container 823. The beverage container 823 may have a removable and replaceable cap for the purpose of placing fluid into the beverage container 823 or removing fluid out. The beverage container 823 is further comprised of a cap that has an opening to permit a straw 870 to pass through for the consumption of a beverage. In one embodiment of 800 the straw 870 passes internally through the container, the O-ring seal 132, and the drink bottle pushing apparatus adapter 820 and into the beverage container 823.

An alternate variation of 800 also presented in FIG. 8 shows the beverage container 823 comprised of an opening at the lower side of the beverage container 823 in close proximity of the bottom wherein the opening creates a port 872 and means for attachment of a straw 870. The straw 870 of which in this variation is located externally in relation to the pushing device 820 and container 110. In the alternate variation of 800 the present invention is further comprised of the straw 870 passing through an opening 864 in the bottom surface 355 of the tray 360 and acts as a holder or guide for the straw 870. The opening 864 is preferred to be located about equidistant from the outer wall 851 of the tray 360 and the proximate center of the tray 360. The description for the opening 864 acting as a holder or guide for the straw 870 is not meant to be limiting and an attachment or guide may also be placed on the outer wall 851 of the tray 360 depending on preference. It can also be appreciated in the embodiment 800 that the beverage container 823 may be adapted to be by itself to function as the pushing device 820 of the invention.

A flexible food grip cuff 865 helps the user control the food during use so it can be held firmly and bitten. In this embodiment, it has a slit with two overlapping ends that slide past each other as the flexible food grip cuff 865 is squeezed. The flexible food grip cuff 865 has a four finger loop 818 for inserting four fingers (or individual fingers as well could work), and on the other side has a thumb loop 819. This allows the user to put his/her hand through the four finger loop 818, and thumb loop 819 and squeeze the flexible food grip cuff 865 to hold and bite off a piece of a solid food, such as a sandwich, as it extends out of opening 140. So when the user wraps his/her hand around the flexible food grip cuff 865, his/her hand is protected from getting food on it. It allows the user to wrap their hand around the food and flexible food grip cuff to direct it and support the food for easy, one-handed consumption.

Figure 9:
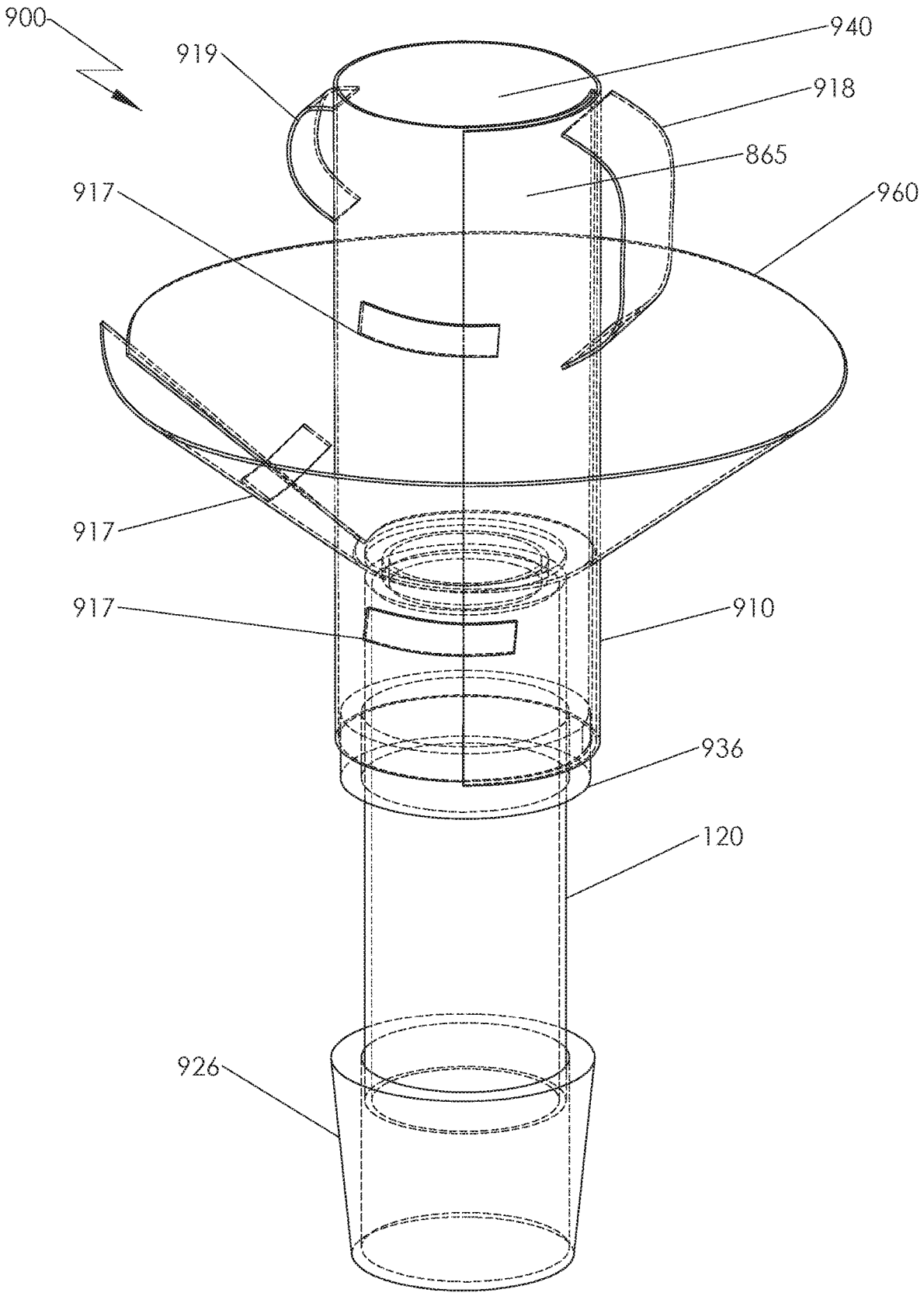
FIG. 9 is a perspective side view representation of another embodiment of the food dispensing device.

FIG. 9 shows embodiment 900 of the invention with the flexible food grip cuff 865. (The flexible food grip cuff is also employed in FIGS. 10, 13 and 14 that can be used in a similar manner by the user.)

Container 910 has a slit which runs its entire length, such that the fasteners 917 may be released to allow the container 910 to be opened along its length. The purpose of opening the container 910 along the side of its length is to receive and hold a sandwich, hoagie or other solid food. Then the container 910 is wrapped around the solid food and the fasteners 917 are re-secured.

Soft semi-liquid foods like chili or foods like spaghetti, or casserole items may be eaten by exchanging the flexible food grip cuff 865 with a nozzle attachment 350 of FIGS. 3 and 4.

FIG. 9 shows an embodiment 900 of the present invention wherein the invention is comprised of a container 910 in a centrically located position in comparison to the tray 960 similar to FIG. 3. The embodiment 900 in FIG. 9 further comprises of a container 910 that is made of a light weight durable material that is both rigid enough to provide protection and support of the food. The item is yet flexible enough to be manipulated in terms of adjusting size in accordance to fit the food item by use of a fastener 917 such as hook and loop connector straps.

Another embodiment 900 further comprises a means to assist in securely holding the container 910 via loops 918 and 919 attached to the sides of the upper portion of the container 910. As discussed above, a flexible food grip cuff 865 helps the user control the food during use so it can be held firmly and bitten. A rigid plastic ring or other rigid material 936 is connected to the bottom inner portion of the container 910 guide of the pushing device 120 and acting as a seal around the outer perimeter of the pushing device 120. The rigid ring 936 allows a hand hold to grasp and push the pushing device 120 into the container 910. This may also be a rubber wiper ring, functioning like a ring on an engine's piston, or like one would see on a rubber syringe plunger. It may employ a flexible gasket recess to accommodate flexible absorbent material such as a paper towel to be wrapped around the Food Pusher Unit at this recess.

An absorbent paper towel that is crumpled and placed below the food, but on top of the food pusher unit 120 forms a drip absorbing layer on the top of the pushing device 120.

Another method of reducing leakage is to wrap a paper towel or cloth around the pushing device 120. These methods work well with moderately juicy foods such as a hoagie.

Embodiment 900 further comprises a tray 960 that is that is made of a nylon fabric material or other suitable material that provides a light weight durable material that is both rigid enough to provide a means to catch crumbs or other bits of food that may fall from the opening 940 of the container 910. The tray 960 of embodiment 900 also comprises a means to adjust its size by use of a fastener 917 such as hook and loop fastener straps to fit appropriately with the container 910. The embodiment 900 has a cup base 926 which is sized to fit securely in a typical automotive cup holder.

Figure 10:
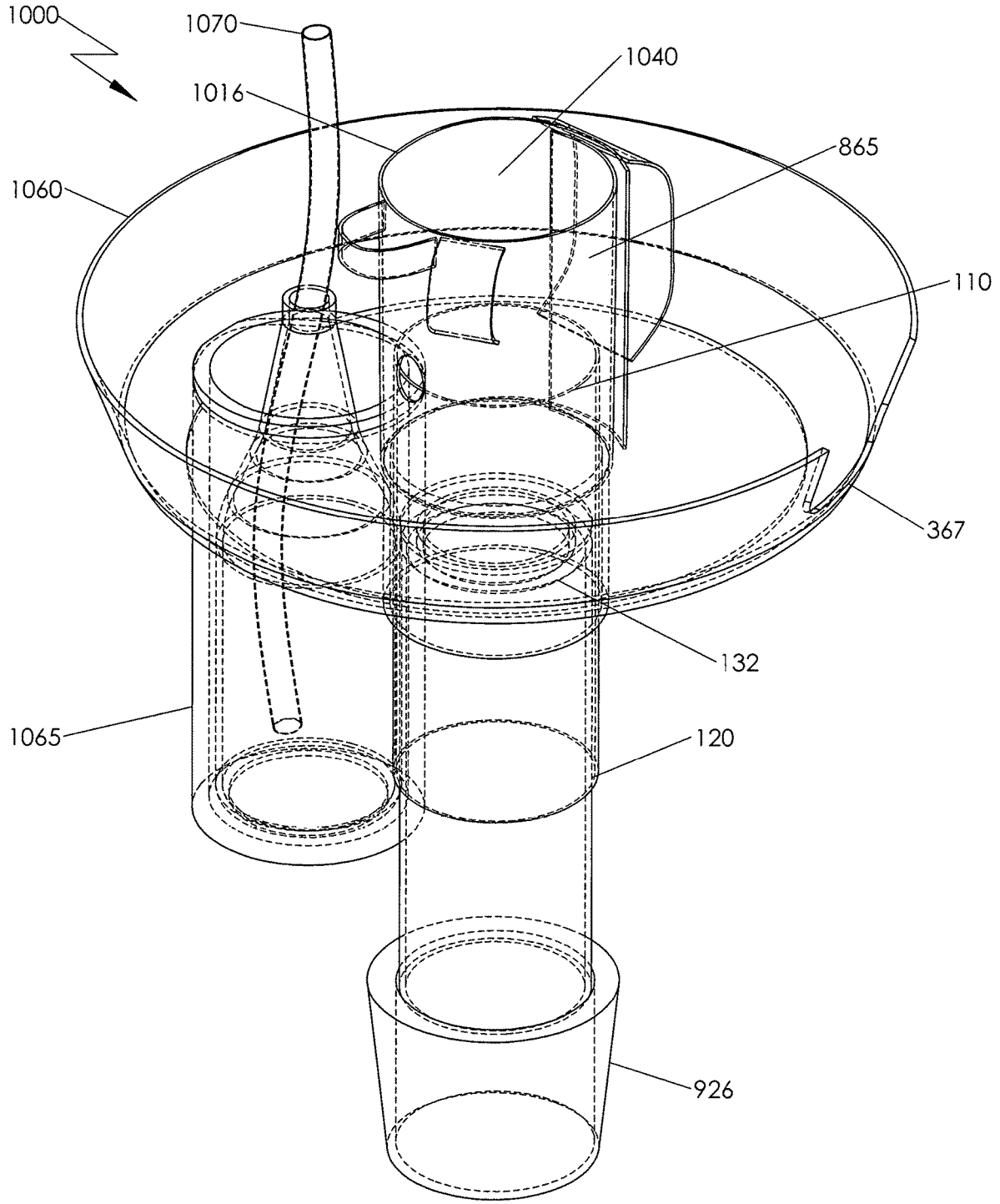
FIG. 10 is a perspective side view representation of another embodiment of the food dispensing device.

Now referring to FIG. 10, it shows an embodiment of the present invention 1000 which further comprises a tray 1060 having a drink holder 1065 that is offset from the approximate center of the tray 1060. The drink holder 1065 comprises a cylindrical shape with walls extending downward from an opening in the bottom surface of the tray 1060 and has a fully enclosed bottom. The drink holder 1065 is made from a similar material as the tray 1060 and is sturdy enough to support a commercial type beverage container such as a soda can, bottle or similar beverage container. It includes a straw 1070 that terminates proximate opening 1040.

Figure 11:
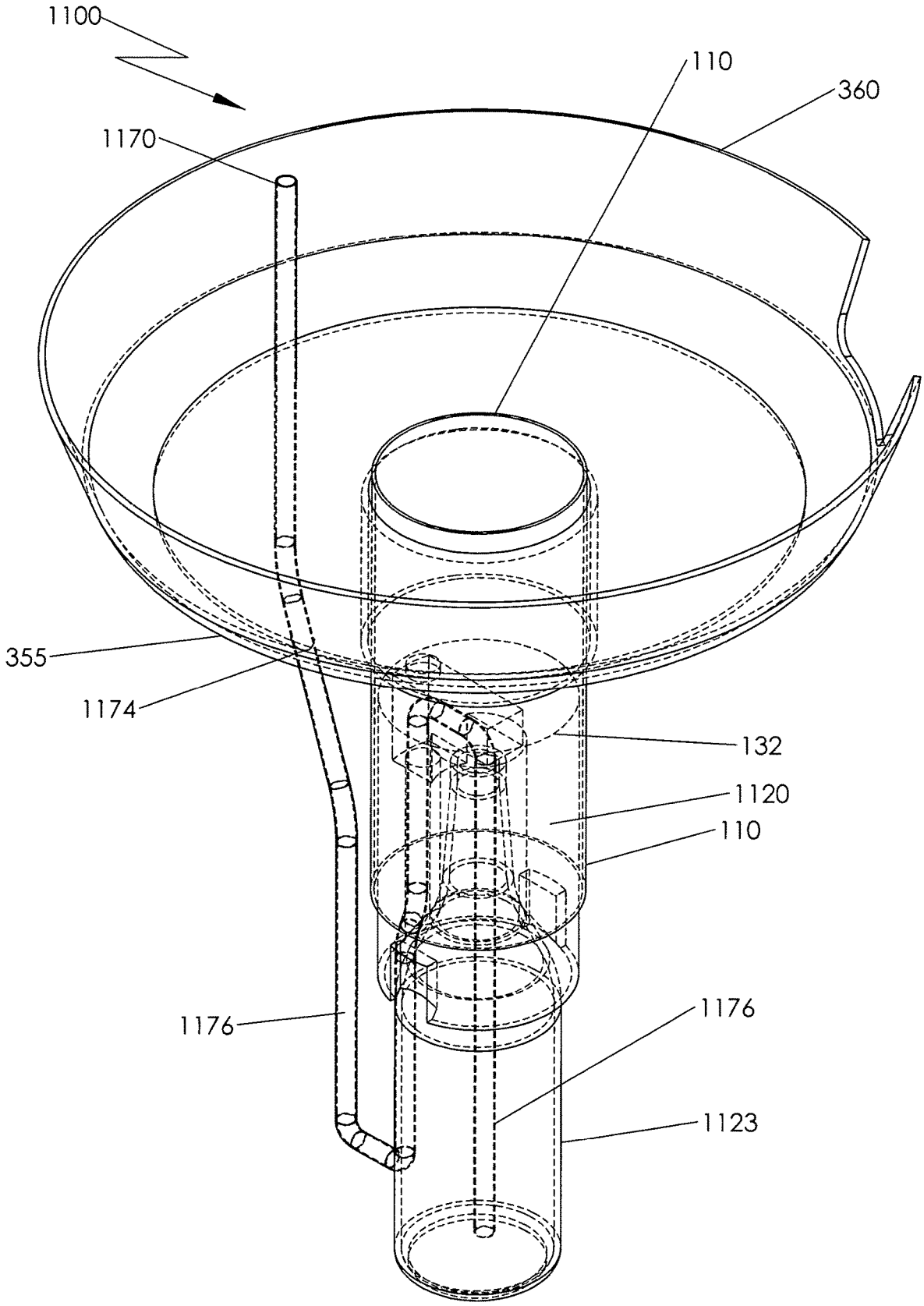
FIG. 11 is a perspective side view representation of another embodiment of the food dispensing device.

FIG. 11 shows an embodiment 1100 of the present invention that comprises similar elements as other previously described embodiments including but not limited to a container 110, a tray 360, and a straw 1170. The embodiment 1100 further comprises an adapted pushing apparatus 1120 that rests on the top surface of a commercially available beverage container 1123 such as a can or bottle. The adapted pushing apparatus 1120 further comprises a means of fluid conveyance via an elongated straw 1170 that extends from the beverage container 1123 on one end, travels through the adapted pushing apparatus 1120 in a "S" shaped configuration 1176 and wherein the opposite end extends through an opening 1174 in the bottom surface 355 of the tray 360 and enabling the user to consume the beverage from the beverage container 1123 used in lieu of the full length pusher apparatus. Adapted pushing apparatus 1120 may use the same seal as mentioned earlier, seal 132.

Figure 12:
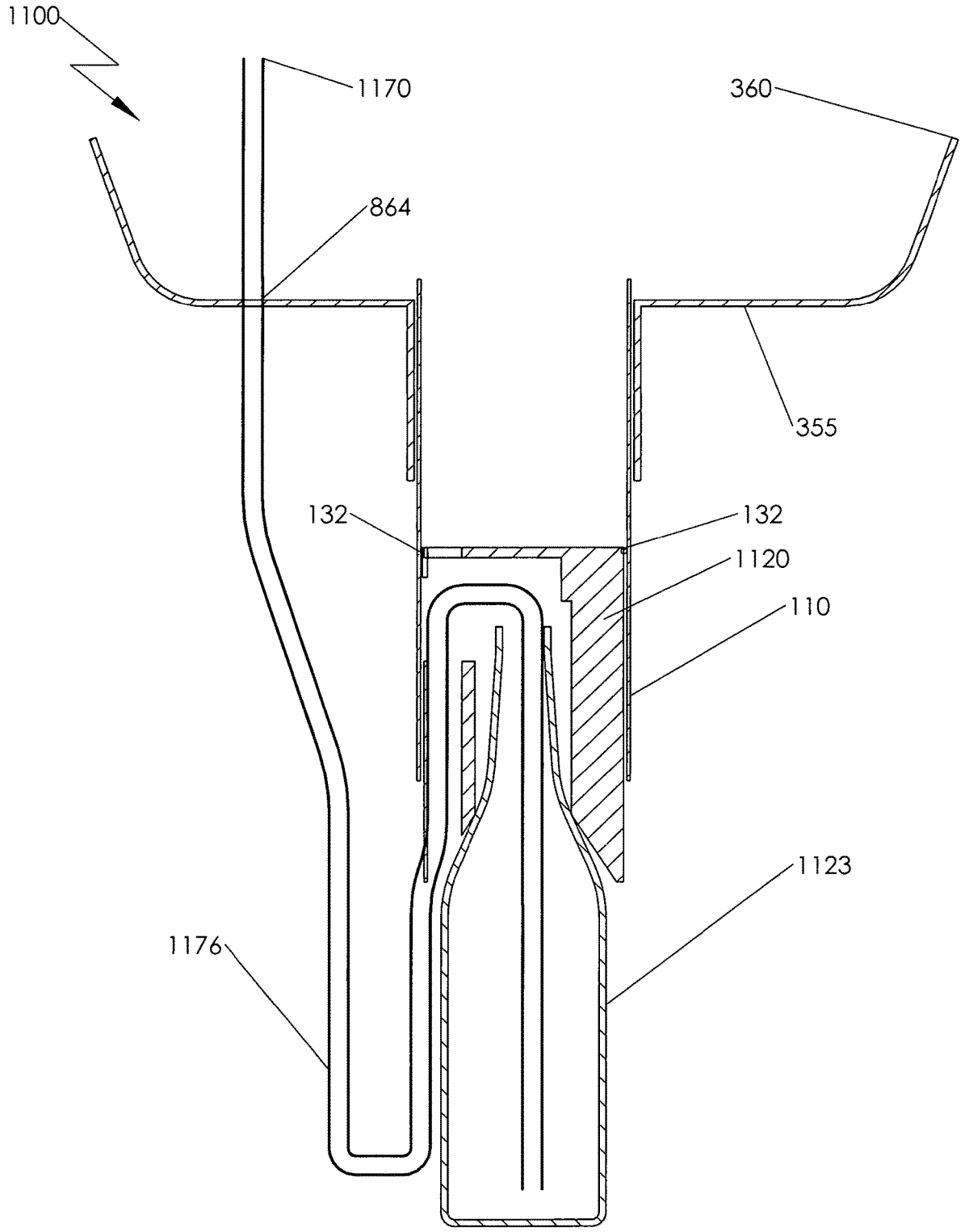
FIG. 12 is a cross-sectional view representation of the inventive embodiment of the food dispensing device of FIG. 11.

FIG. 12 shows a side view diagram of embodiment 1100 of FIG. 11. The side view diagram 1100 assists in showing the placement of the "S" shaped configuration 1176 aspect of the straw 1170 which extends from the beverage container 1123, through the adapted pushing apparatus 1120 and up through the bottom surface 355 of the tray 360.

Figure 13:
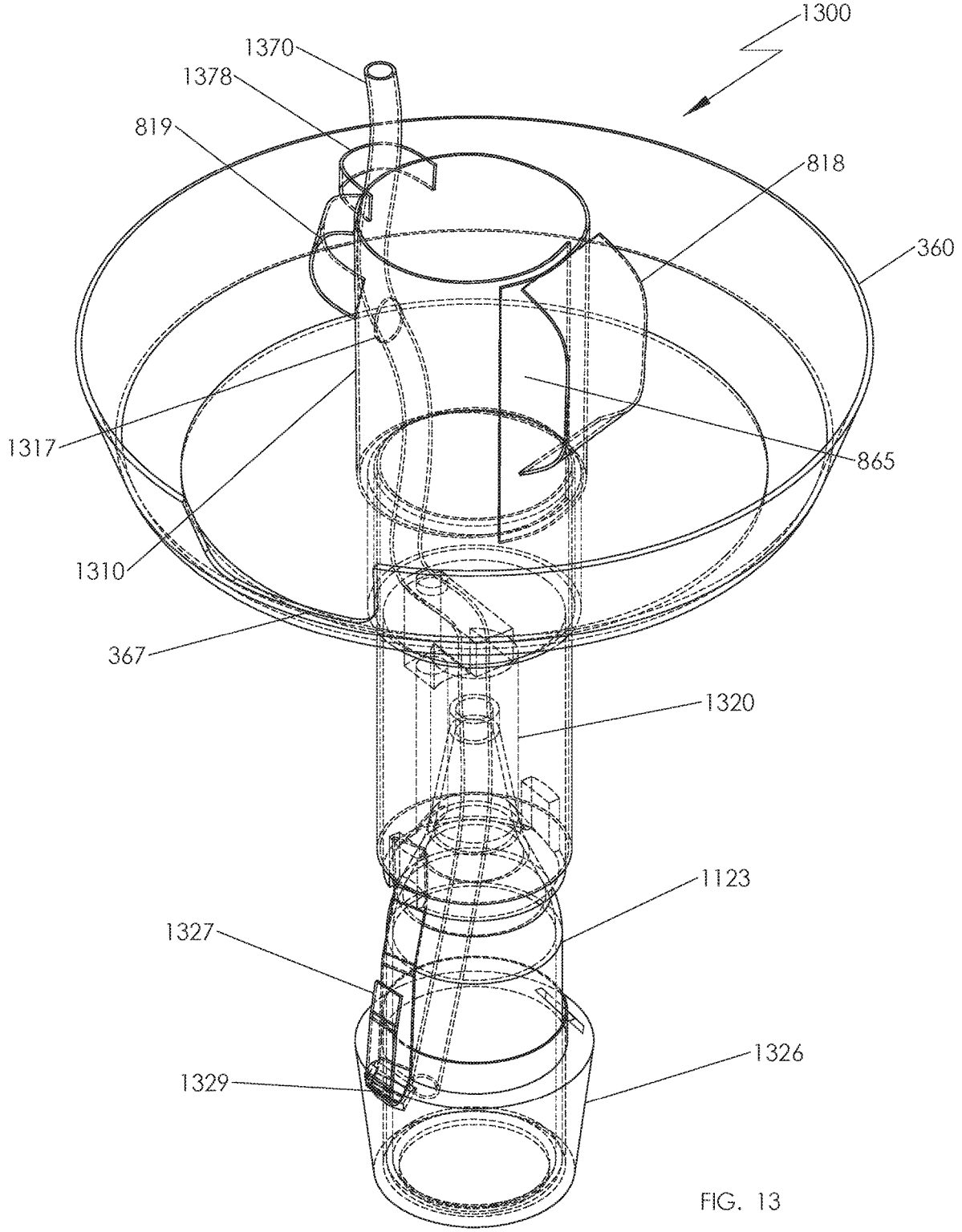
FIG. 13 is a perspective side view representation of another embodiment of the food dispensing device.

FIG. 13 shows an embodiment 1300 of the present invention that comprises a container 1310, a tray 360 and a pushing apparatus 1320 as in other previously described embodiments. Embodiment 1300 further comprises loops 818 and 819 to assist with gripping the container 1310. As discussed above, a flexible food grip cuff 865 helps the user control the food during use so it can be held firmly and be bitten. A straw holder 1378 is attached to the side of the container 1310 proximate to the top edge of the container 1310. The straw 1370 in the embodiment 1300 feeds through an opening 1317 in the side of the container 1310 and then runs internally through the bottom of the container 1310 and continues through an opening in the top of the adapted pusher apparatus 1320 to the beverage container 1123. The pushing apparatus 1320 is further comprised of being adapted to accommodate a previously described adapted pusher apparatus 1320 that sets on top of a beverage container 1123. The pushing apparatus 1320 is further comprised of a means to secure the beverage container 1123 within the pushing apparatus 1320 via use of a tethering attachment 1327 attached on one end to the bottom portion of the pushing device 1320 and on the other end to the top portion of the drink cup adapter base 1326. Only one tethering strap is shown for the clarity. Others may be used, as needed.

Figure 14:
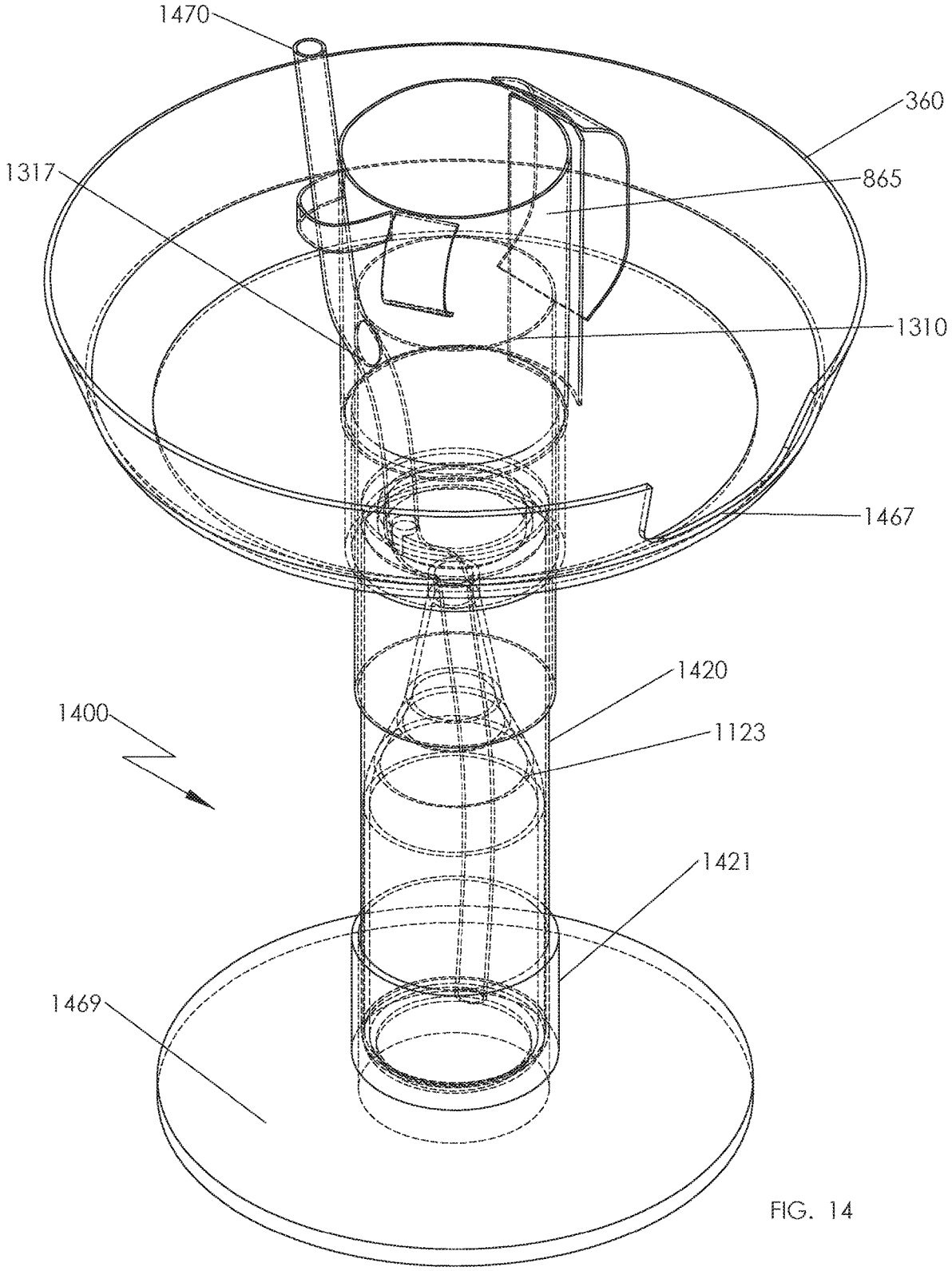
FIG. 14 is a perspective side view representation of another embodiment of the food dispensing device.

FIG. 14 shows an embodiment 1400 of the present invention that comprises a container 1310, a tray 360 having a wrist notch 1467, a straw 1470 and a pushing apparatus 1420 as in other previously described embodiments. As discussed above, a flexible food grip cuff 865 helps the user control the food during use so it can be held firmly and bitten. Embodiment 1400 further comprises a base 1469. The base 1469 is further comprised of a means for attachment 1421 permitting the present invention to be placed on a flat or table-like surface and allows the completely hands-free operation of the invention. The means of attachment 1421 may be proportionate in diameter to fit on the outer circumference of the pushing apparatus 1420 while permitting a beverage container 1123 to fit therein. Also, the automotive cup base 926 may be used, as seen in FIG. 9.

Though not shown here, the S-straw could be built into pushing apparatus 1420, similar to FIG. 13.

Figure 15:
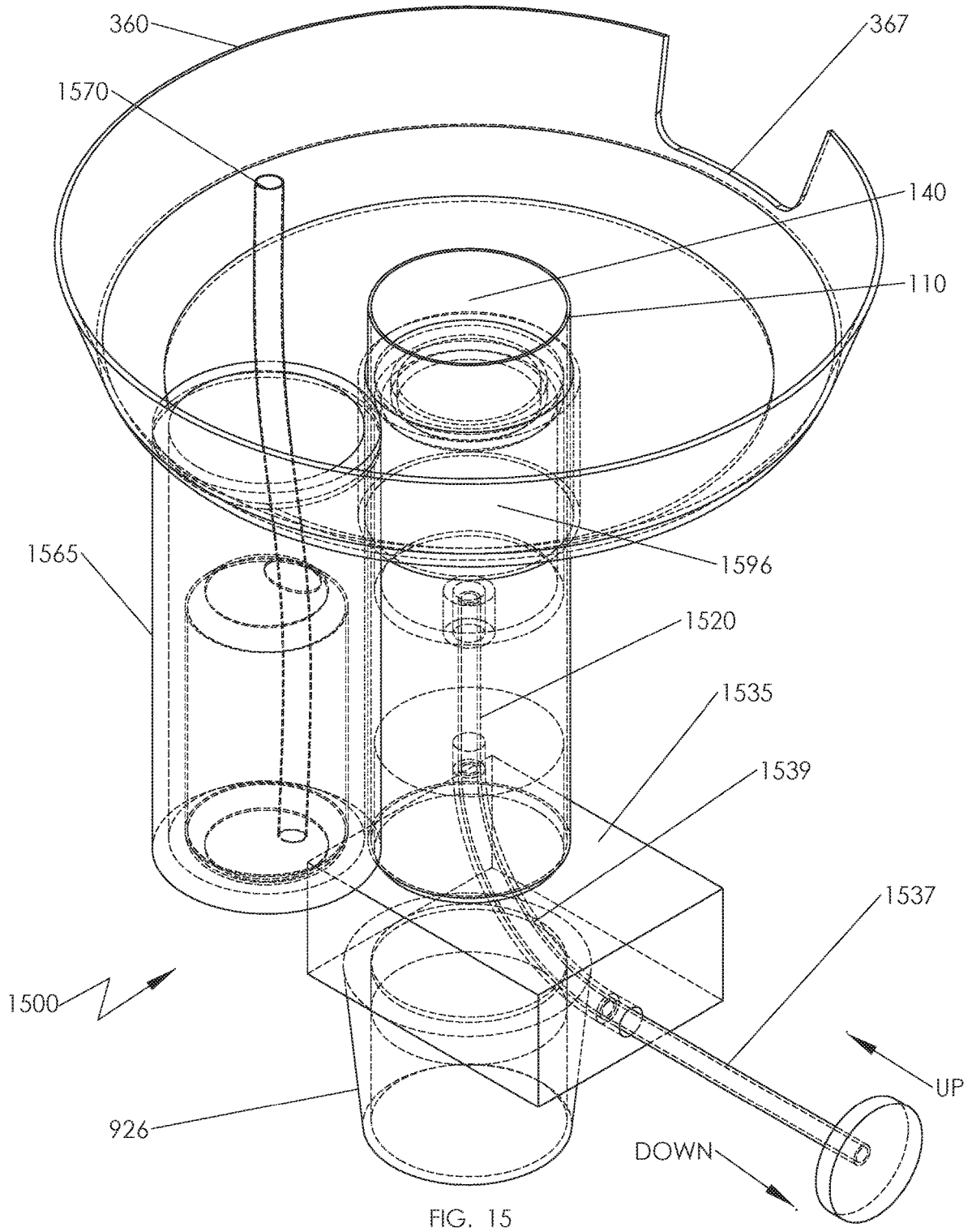
FIG. 15 is a perspective side view representation of another embodiment of the food dispensing device.

FIG. 15 shows an embodiment 1500 of the present invention which comprises similar elements as previously described in previous figures, such as FIG. 10. The embodiment 1500 in FIG. 15 further comprises a drink holder 1565, a straw 1570, a pushing apparatus 1520 which includes a pushing rod 1537, a pushing block 1535, and a pushing cylinder 1596. The pushing rod 1537 starts outside of pushing block 1535, enters the side of pushing block 1535, and travels through a channel 1539 in the pushing assembly block 1535. It exits out the top of the pushing assembly block 1535 and extends upward, toward, and attaches to the pushing cylinder 1596.

The pushing cylinder 1596 is proportionate in size to fit inside the container 110 and has the capability to slide up and down within the container 110. The pushing rod 1537 is flexible and allows directional change in the force applied to the pushing cylinder 1596.

By the user manually pushing the pushing rod 1537 toward and into the pushing assembly block 1535, the user can push up the pushing cylinder 1596 and in turn move the food item upward through the container 110 and extend out of opening 140. If the food item is extended out of opening 140 too far, the user can pull on the pushing rod 1537 and the mechanism will reverse and retract the food item back into the container 110.

Figure 16:
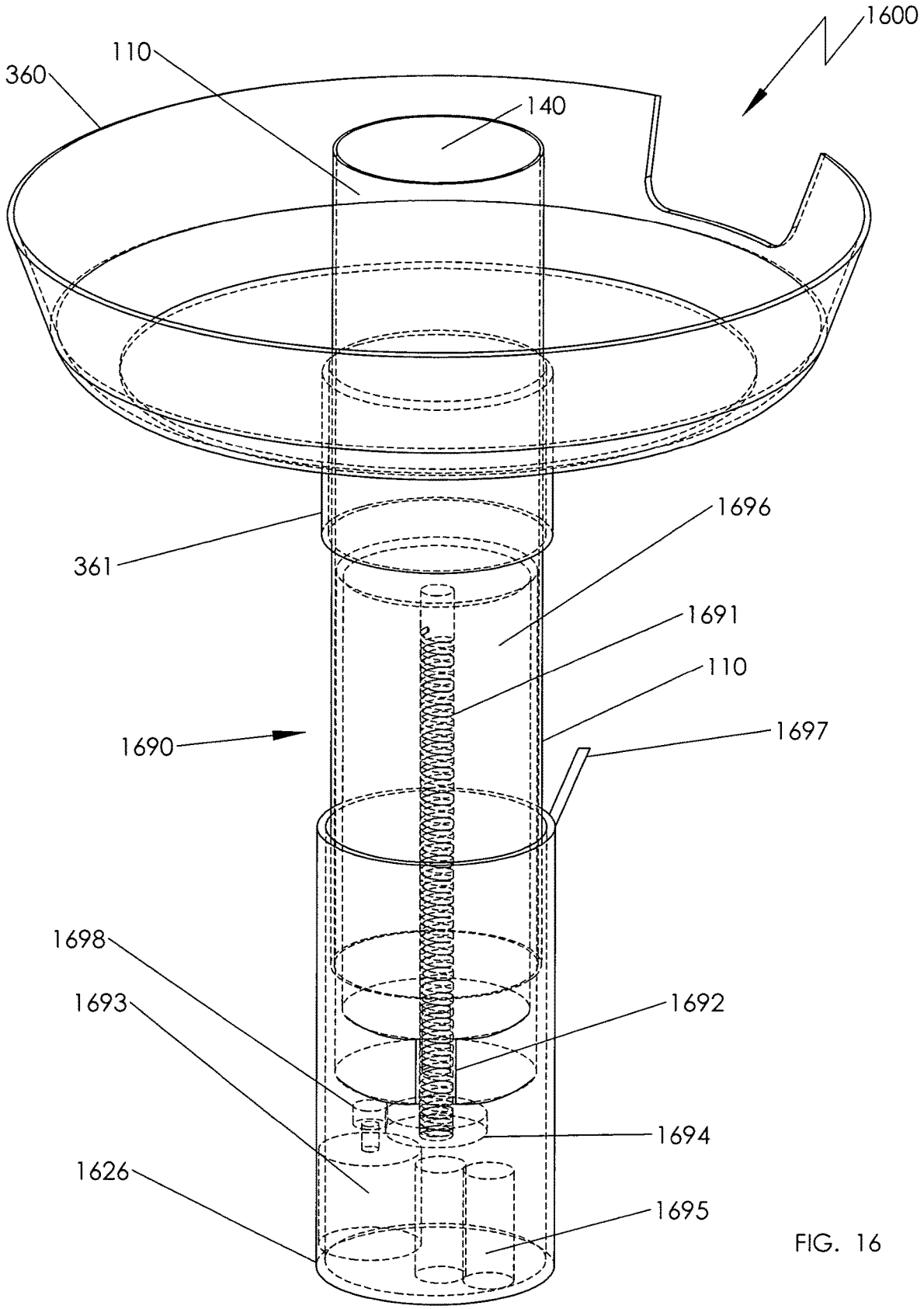
FIG. 16 is a perspective side view representation of another embodiment of the food dispensing device.

FIG. 16 shows an embodiment 1600 that comprises similar elements to those previously described above including but not limited to a container 110, tray 360, and container guide 361. Embodiment 1600 further comprises a mechanical pushing apparatus 1690 to push the food item up and out the top of the container 110. The mechanical pushing apparatus 1690 further comprises a two-piece hollow cylinder made from a rigid material in which its bottom piece is an elongated version of the drink cup adapter base 1626 and its top is the actuator plate which is the top of the pushing apparatus cylinder 1696. The elongated version of the drink cup adapter base 1626 houses the electric motor 1693, motor drive gear 1698, screw drive gear 1694, battery pack 1695, and threaded screw 1691. The mechanical pushing apparatus 1690 is operated by using a momentary switch 1697 that allows for the mechanical pushing apparatus 1690 to operate in both forward and reverse. The mechanical pushing apparatus 1690 uses an electric motor 1693 to turn the drive gears 1694, 1698 and threaded screw 1691 which in the process drives a drive nut 1692 attached to the actuator cylinder 1696 up the container 110 to push the food item up and out the opening of the container 110. As the threaded screw 1691 spins, the drive nut 1692 moves in a vertical direction inside container 110.

This is one specific example of how to implement a motorized means of moving the actuator plate, however it is understood that belts, pulleys, rods, air or hydraulic cylinders, etc. that are now commonly known may be used to advance the food out of the container 110.

Figure 17:
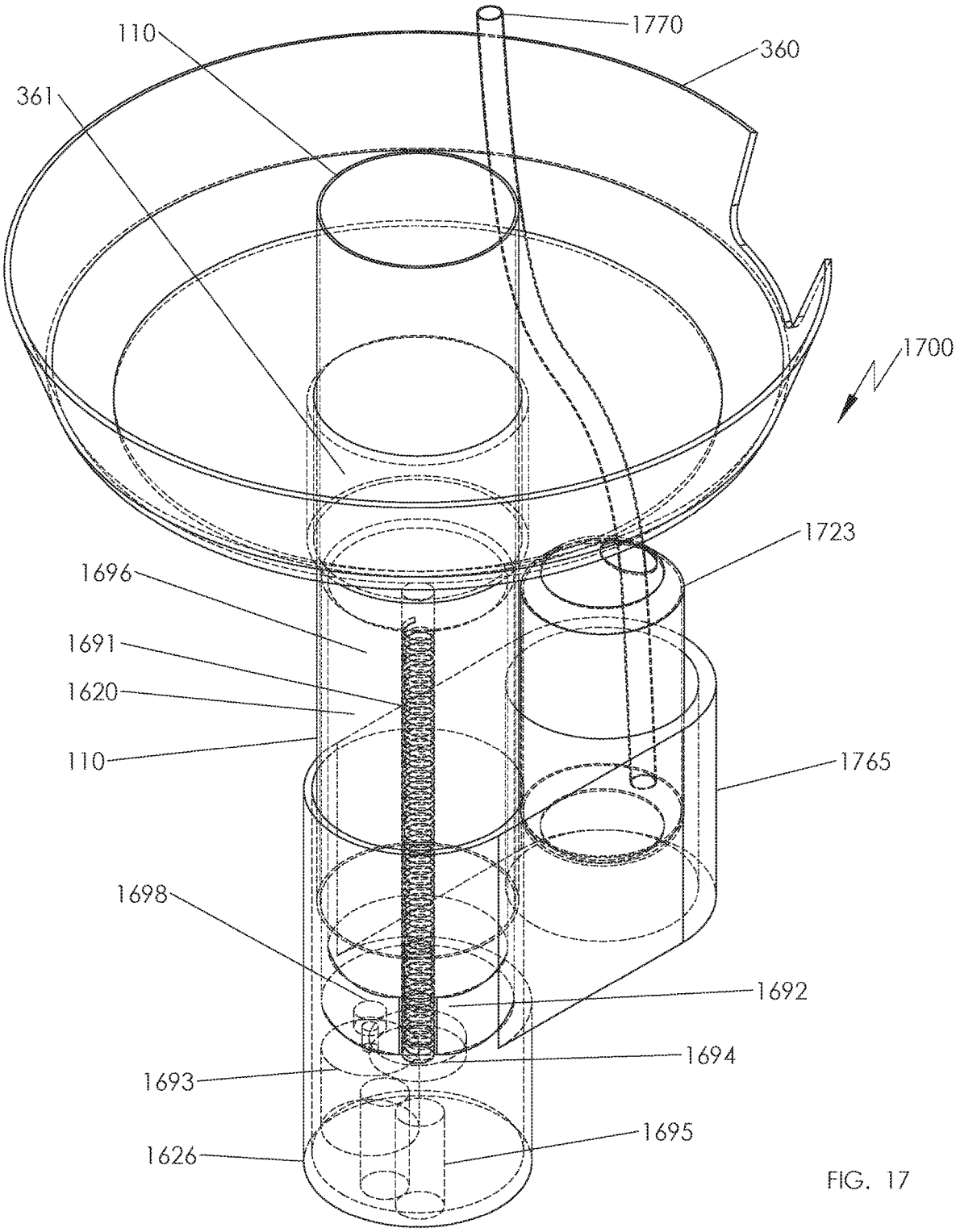
FIG. 17 is a perspective side view representation of another embodiment of the food dispensing device.

FIG. 17 shows an embodiment 1700 that comprises similar elements to those previously described above including but not limited to a container 110, tray 360, container guide 361, and mechanical pushing apparatus 1690. Embodiment 1700 further comprises an offset beverage container holder 1765. The offset beverage container holder 1765 is attached to the outer side surface of container 110. The offset beverage container holder 1765 can accommodate a beverage container 1723 and by utilizing a straw 1770 the user can also consume a beverage while using the mechanized variant of the present invention. By adding a base stand or mounting bracket this can be used by a user without requiring the user to use his/her hands.

The beverage container shown in the previous figures resembles a standard bottle or can. However, it could actually be shaped like a tall "donut" that wraps around container 110, either fully wrapping around or partially around, and the straw would penetrate it. It would have a removable fill cap. This donut shaped "canteen" could sit just under the food tray and the fill cap could be extending above the inner bottom surface of the food tray.

Figure 18:
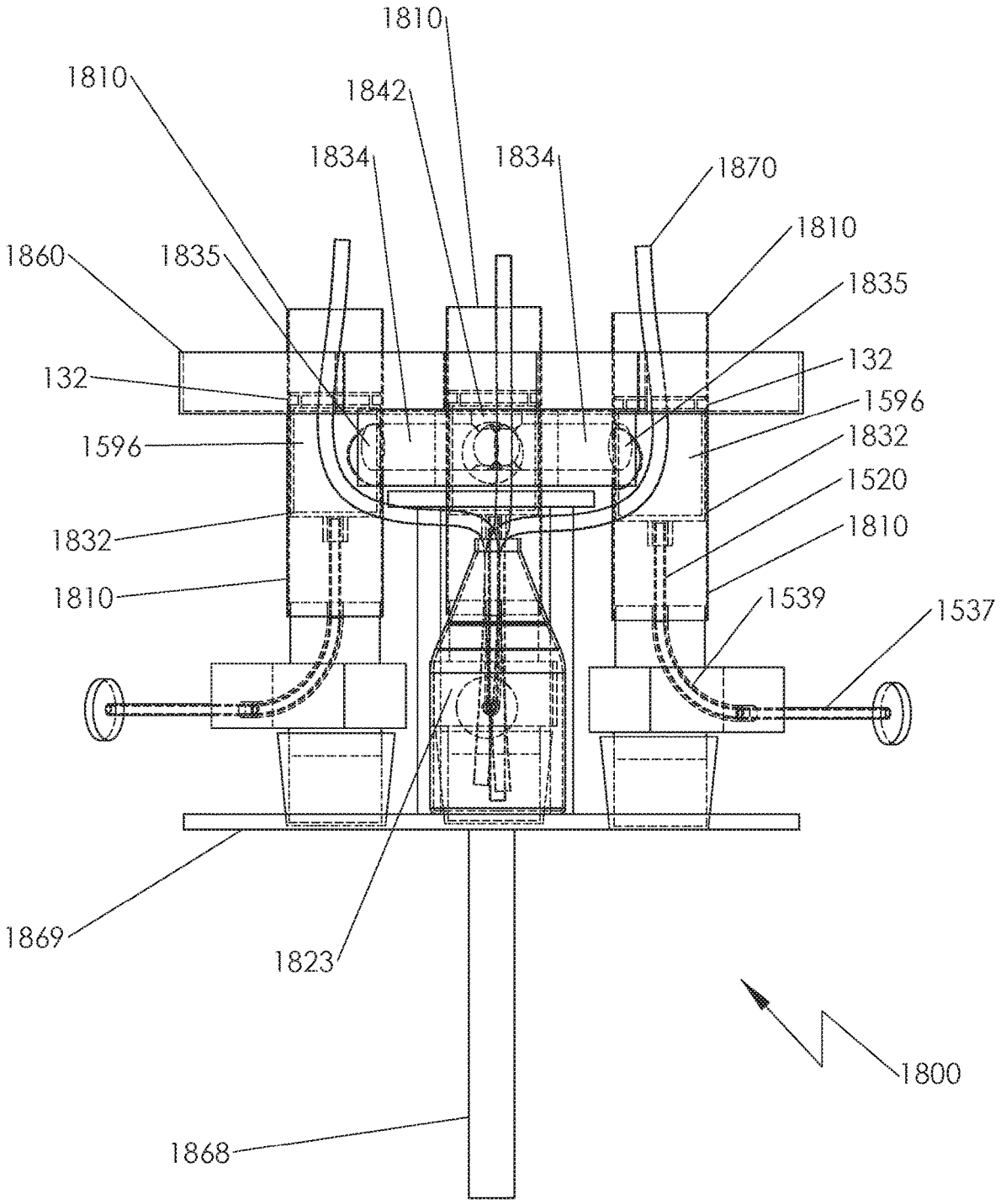
FIG. 18 is a side view representation of another embodiment of the food dispensing device.
Figure 19:
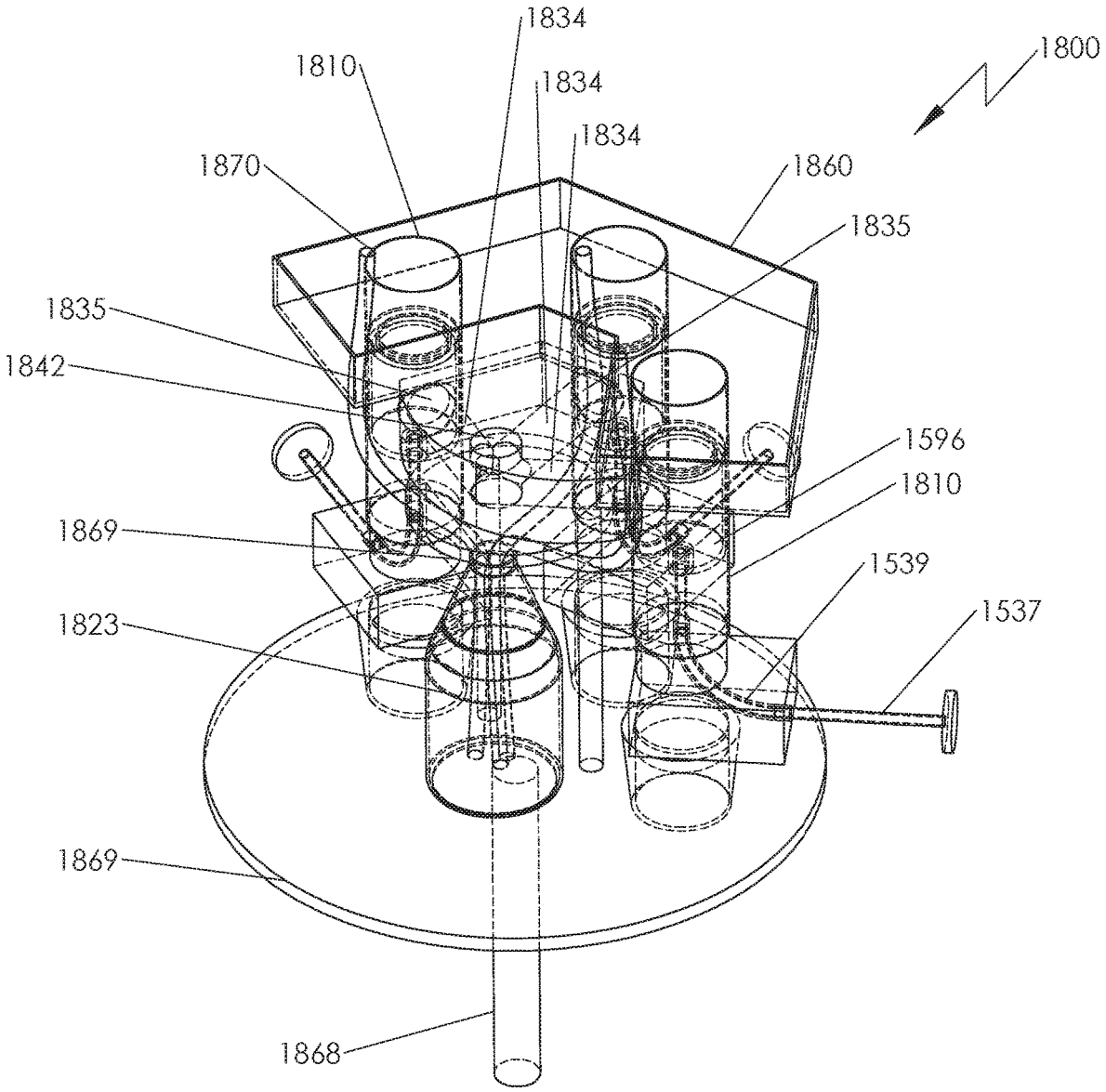
FIG. 19 is a perspective side view representation of the embodiment shown in FIG. 18 of the food dispensing device.

FIGS. 18 and 19 show of an embodiment 1800 that comprises the previously described elements including but not limited to three modified versions of the embodiment of FIG. 15 to result in a configuration for multiple users. The three devices described in FIG. 15 to work together to serve multiple users simultaneously. The three devices sit on a common holder 1869. This embodiment's intended purpose is to feed and provide drink to multiple people at the same time. One ideal application would be for feeding children in the back seat of a vehicle. The unit could be bolted down by a base attaching to the bottom of support rod 1868 to be in close proximity to the seats where the users (children) are sitting. Embodiment 1800 further comprises a port opening 1835 on the side of each container 1810 which is fluidically coupled to a manifold 1834. Liquid food is provided into tray 1860 having a manifold port 1842 that is also fluidically coupled to the manifold 1834.

The liquid food flows from tray 1860 through the manifold 1842, ports 1835 in the sides of containers 1810 to fill container 1810.

Embodiment 1800 further comprises a longer pushing rod 1537 than on other embodiments so that when it moves upward it keeps the port 1835 closed throughout the entire travel upward. Also, the pushing cylinder 1596 has a second O-ring 1832 at the bottom to prevent food from the port opening 1835 getting down past the bottom of the pushing apparatus 1520 between it and the inner wall of the container 1810. The pushing cylinder 1596 is elongated with O-ring seal 132 at top and O-ring seal 1832 at the bottom.

FIG. 19 shows embodiment 1800 in a perspective view that comprises the previously described elements including but not limited to those of FIG. 15 and FIG. 18. A common drink jug 1823 or individual drinks can be tapped with straws 1870. Drinking straws may include flow check back flow preventers.

FIGS. 18 and 19 show a manifold feed opening 1842 which is connected to the manifold runners 1834 which link to the ports 1835 of containers 1810. Liquid food may be provided to a storage vessel resting on top of, and feeding liquid food into the manifold feed opening 1842.

The containers 1810 may be refilled from the storage vessel by the food running through the manifold runners 1834 attached to the side of the containers 110. Ports in the sides of the containers 110 allow the food enter the containers 110 through a port 1835 in the side of each container 110. This allows the containers 110 to be refilled. Ports 1835 may include flow check.

As indicated above, the embodiments may be made of paper, cardboard, composites or other known disposable material. Alternatively, they may also be made from rigid Plastic which can be Cleaned and Reused.

ADVANTAGES OF THE EMBODIMENTS

The current invention solves the following shortcomings of the prior art.

It provides ability for "no hands" eating and drinking when the unit is on a table or holder arm (i.e. over a hospital bed).

There is no need to touch the food or hold other utensils like forks, spoons, knives or bowls.

There is no need for separate utensils such as forks, spoons, knives, bowls, and plates to eat a meal.

Pre-packaged food can be put into the "pump" as a sealed cartridge that is opened when one is ready to eat.

The invention provides both convenience and speed of eating/drinking having both food and drink served from one receptacle.

The invention reduces and almost eliminates possibility for spillage—it greatly reduces food and beverage coming into contact with clothing and upholstery, and other areas not intended.

It is more sanitary and protects food and beverage from coming in contact with contaminants better than conventional devices.

The invention enables revolution in the fast food packaging. The invention may be brought to fast food restaurants, filled, and used, thereby reducing packaging waste. The invention may be re-filled at a drive up window, or it may be taken into the restaurant and filled by the user, or a fast-food restaurant worker. If the user takes the invention in a restaurant they can fill it with whatever they like at a buffet.

Other embodiments could have other known methods to move the food to a location near the user's mouth. A conveyor belt, a positive displacement pump, a squeezed bag, etc. could all be used to move the food in place of the food pusher/dispenser shown in the figures. Any pumping action would still be moving food to a location near the user's mouth that is also near the drink straw end location. These embodiments of the invention have primarily focused on the food dispenser unit and the food pusher unit as being the primary way to move the food.

Purchasing and dispensing beverage in bulk is possible with this design. The unit can be made to hold a large jug of beverage, such as a gallon jug of iced tea or juice. Buying beverage in bulk saves money and reduces individual serving size packaging waste.

It should be appreciated that the foregoing is presented by way of illustration only, and not by way of any limitation, and that various alternatives and modifications may be made to the illustrated embodiments without departing from the spirit and scope of the present invention.

What I claim is:

1. A food dispenser for allowing a user to feed oneself without the use of one or both hands, the food dispenser comprising:

a. an elongated food container being filled with a food, and having a first end and a second end with a first opening located at the first end and a second opening located at the second end, the first opening being a first elongated food container opening;

b. a pushing apparatus having a pushing block, wherein the pushing block includes a first end and a second end such that the first end of the pushing block is located over the second opening of the elongated food container, a flexible pushing rod slidably retained within the pushing block such that the flexible pushing rod has a first end and a second end, wherein the first end of the flexible pushing rod enters into a side of the pushing block and travels through a channel in the pushing block, thereby creating a directional change in a force applied to a pushing cylinder, wherein the pushing cylinder is operatively connected to the first end of the flexible pushing rod such that the pushing cylinder is slidably retained within the elongated food container such that when the user pushes the second end of the flexible pushing rod into the side of the pushing block, the first end of the flexible pushing rod moves the pushing cylinder into the elongated food container, thereby causing the food located within the food container to be pushed out of the first elongated food container opening by the pushing cylinder;

c. a cup base having a first end and a second end such that the cup base is located below the pushing block and the elongated food container is located above the pushing block and the second end of the elongated food container is operatively connected to the first end of the pushing block and wherein the first end of the cup base is operatively connected to the second end of the pushing block and the second end of the cup base is sized to fit securely in a typical automotive cup holder;

d. a slidable seal which is disposed between an outer surface of the pushing cylinder and an inner surface of the elongated food container, wherein the slidable seal contacts the inner surface of the elongated food container to prevent leaking of liquids from the elongated food container; and e. a tray attached to the elongated food container at the first end adjacent to the first elongated food container opening such that the tray is capable of catching liquids or pieces of food dripping from the first elongated food container opening.

2. The food dispenser of claim 1, further comprising:

a cover which fits over and encloses the tray.

3. The food dispenser of claim 1, further wherein:

the tray has at least one compartment.

4. The food dispenser of claim 1, wherein:

the elongated food container and the pushing cylinder both have cross-sections being one of the group consisting of: round, oval, square or rectangular cross sections.

5. The food dispenser of claim 1, wherein:

the tray includes a fastener to adjust a diameter of the tray thereby allowing the tray to expand or contract in size such that the tray will fit an outer perimeter of the elongated food container.

6. The food dispenser of claim 1, further comprising:

a plurality of loops operatively connected to the first end of the elongated food container for receiving fingers of the user, thereby allowing the user to get a grip on the elongated food container.

7. The food dispenser of claim 5, further comprising:

a container edge which is made of a flexible material and is operatively connected to the first elongated food container opening, thereby allowing the user to grip the container edge and squeeze the container edge so as to grip the food, thereby allowing manipulation of the food; and at least one slit located adjacent to the container edge for allowing the elongated food container to bend and hold the food.

8. The food dispenser of claim 1, further comprising:

a beverage container located adjacent to the elongated food container, wherein the beverage container has a straw leading to a location adjacent to the first elongated food container opening, thereby allowing the user to drink through the straw.

9. The food dispenser of claim 8, further comprising:

a beverage container holder located adjacent to the elongated food container for securing the beverage container to the food dispenser.

10. The food dispenser of claim 1, further comprising:

a. a flexible food grip cuff located adjacent to the first elongated food container opening, wherein the flexible food grip cuff reduces a diameter of the elongated food container when squeezed; and b. a holding apparatus located adjacent to the flexible food grip cuff, for allowing the user to grip and hold and squeeze the flexible food grip cuff thereby allowing the user to hold and control the food inside of the elongated food container, where the food is a solid food, thereby allowing the user to bite off a piece of the food extending out of the first elongated food container opening.

11. The food dispenser of claim 1, further comprising:

a removable, pre-packaged cartridge filled with the food, wherein the cartridge can be placed within the food container.

12. The food dispenser of claim 1, further comprising:

a nozzle operatively connected to the first elongated food container opening.

13. A food dispenser for providing drink and food to a consuming location of a user, the food dispenser comprising:

a. a food container for holding a desired food, the food container having first and second food container openings from which the food may exit the food container out of the first food container opening;

b. a pushing apparatus having a pushing block, wherein the pushing block includes a first end and a second end such that the first end of the pushing block is located over the second food container opening, a flexible pushing rod slidably retained within the pushing block such that the flexible pushing rod has a first end and a second end, wherein the first end of the flexible pushing rod enters into a side of the pushing block and travels through a channel in the pushing block, thereby creating a directional change in a force applied to a pushing cylinder, wherein the pushing cylinder is operatively connected to the first end of the flexible pushing rod such that the pushing cylinder is slidably retained within the food container such that when the user pushes the second end of the flexible pushing rod into the side of the pushing block, the first end of the flexible pushing rod moves the pushing cylinder into the food container, thereby causing the food located within the food container to be pushed out of the first food container opening by the pushing cylinder;

c. a cup base having a first end and a second end such that the cup base is located below the pushing block and the food container is located above the pushing block and the second food container opening of the food container is operatively connected to the first end of the pushing block and wherein the first end of the cup base is operatively connected to the second end of the pushing block and the second end of the cup base is sized to fit securely in a typical automotive cup holder;

d. a slidable seal which is disposed between an outer surface of the pushing cylinder and an inner surface of the food container, wherein the slidable seal contacts the inner surface of the food container to prevent leaking of liquids from the food container;

e. a beverage container operatively connected to the food container; and f. a drinking conduit extending from the beverage container to the consuming location of the user adjacent to the first food container opening.

14. A food dispenser allowing a user to feed oneself without the use of one or both hands, the food dispenser comprising:

a. an elongated food container being filled with a food, and having a first end and a second end with a first opening located at the first end and a second opening located at the second end, the first opening being a first elongated food container opening;

b. a pushing apparatus having a pushing block, wherein the pushing block includes a first end and a second end such that the first end of the pushing block is located over the second opening of the elongated food container, a flexible pushing rod slidably retained within the pushing block such that the flexible pushing rod has a first end and a second end, wherein the first end of the flexible pushing rod enters into a side of the pushing block and travels through a channel in the pushing block, thereby creating a directional change in a force applied to a pushing cylinder, wherein the pushing cylinder is operatively connected to the first end of the flexible pushing rod such that the pushing cylinder is slidably retained within the elongated food container such that when the user pushes the second end of the flexible pushing rod into the side of the pushing block, the first end of the flexible pushing rod moves the pushing cylinder into the elongated food container, thereby causing the food located within the elongated food container to be pushed out of the first elongated food container opening by the pushing cylinder;

c. a cup base having a first end and a second end such that the cup base is located below the pushing block and the elongated food container is located above the pushing block and the second end of the elongated food container is operatively connected to the first end of the pushing block and wherein the first end of the cup base is operatively connected to the second end of the pushing block and the second end of the cup base is sized to fit securely in a typical automotive cup holder;

d. a slidable seal which is disposed between an outer surface of the pushing cylinder and an inner surface of the elongated food container, wherein the slidable seal contacts the inner surface of the elongated food container to prevent leaking of liquids from the elongated food container;

e. a tray attached to the elongated food container at the first end adjacent to the first elongated food container opening, wherein the tray is capable of catching liquids or pieces of the food dripping from the first elongated food container opening and wherein the tray includes a fastener to adjust a diameter of the tray thereby allowing a size of the tray to expand or contract such that the tray will fit an outer perimeter of the elongated food container; and f. a beverage container holder located adjacent to the elongated food container for securing a beverage container to the food dispenser.

15. The food dispenser of claim 14, wherein the tray has at least two compartments and the tray compartments are separated by at least one divider.

* * * * *